US006320604B1

(12) United States Patent
Moriya et al.

(10) Patent No.: US 6,320,604 B1
(45) Date of Patent: Nov. 20, 2001

(54) MULTI POWER TYPE THERMAL HEAD

(75) Inventors: Bunji Moriya; Shinichiro Hayashi; Kazuhito Uchida, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/604,000

(22) Filed: Jun. 26, 2000

(30) Foreign Application Priority Data

Jun. 29, 1999 (JP) ..... 11-183041
Jun. 29, 1999 (JP) ..... 11-183042

(51) Int. Cl.[7] ..... B41J 2/35; B41J 2/335
(52) U.S. Cl. ..... 347/211; 347/206
(58) Field of Search ..... 347/211, 210, 347/200, 206

(56) References Cited

FOREIGN PATENT DOCUMENTS 11-7243 1/1999 (JP) .
11-138883 5/1999 (JP) .
11-208008 8/1999 (JP) .
04220360 * 8/1992 (JP) ..... 347/200
05261953 * 10/1993 (JP) ..... B41J/2/335

* cited by examiner

*Primary Examiner*—N. Le
*Assistant Examiner*—K. Feggins
(74) *Attorney, Agent, or Firm*—Morgan, Lewis & Bockius LLP

(57) ABSTRACT

A multi power type thermal head which has a heating element for producing heat with different energies, an added resistor being connected to the heating element, first switch element for controlling the heating element in an operation state or a nonoperational state, and second switch element for controlling the heating element and the added resistor in an operation state or a nonoperational state. To control the thermal head in a first energy state, heating the heating element is controlled by the first switching element. To control the thermal head in a second energy state, the heating element and the added resistor are controlled by the second switching element with the heating element and the added resistor connected in series.

8 Claims, 15 Drawing Sheets

CONTROL GATE TIMING CHART
(BINARY HISTORY CONTROL): DUAL POWER LEVEL TYPE
1 CYCLE
T1
t1
t2
t3
t4
t5
STROBE 1
GATE A1
GATE A2
GATE B1
GATE B2

STROBE 2
GATE C1
GATE C2
t6
t7
t8
T2
1 CYCLE

ENERGY SETTING EXAMPLE IN RELATED ART

ENERGY SETTING EXAMPLE ACCORDING TO INVENTION

FIG. 13A

< LOGIC TABLE >

| | | | | | | | | | | |
|---|---|---|---|---|---|---|---|---|---|---|
| INPUT | $\overline{\text{STROBE Q}}$ | * | 0 | * | * | 0 | 0 | * | 1 | 1 |
| | $\overline{\text{STROBE q}}$ | 0 | 0 | 0 | 0 | 1 | 0 | 1 | 0 | 1 |
| | Q1 | 0 | 1 | 1 | 1 | 1 | 0 | 0 | * | 1 |
| | q1 | 1 | 0 | 1 | 1 | * | 0 | * | 0 | * |
| IN-CIRCUIT OUTPUT | GQn | * | 1 | 1 | * | 1 | * | * | * | * |
| | Gqn | 1 | * | * | 1 | * | * | * | * | * |
| OUTPUT | DQn | ON | ON | ON | ON | ON | OFF | OFF | OFF | OFF |

*: "0" OR "1"

FIG. 13B

< GQn OUTPUT >

| | | | | |
|---|---|---|---|---|
| IN-CIRCUIT OUTPUT | GAn | 1 | 0 | * |
| | GBn | 1 | 1 | 0 |
| OUTPUT | GQn | 1 | 0 | 0 |

FIG. 13C

< GAn OUTPUT >

| | | | | | | | | |
|---|---|---|---|---|---|---|---|---|
| INPUT | $\overline{\text{GATE A1}}$ | 0 | 0 | 1 | 1 | 0 | 1 | 0 |
| | $\overline{\text{GATE A2}}$ | 0 | 1 | 0 | 1 | 1 | 0 | * |
| LATCH DATA | Q2 | 0 | 0 | * | * | 0 | * | 1 |
| | LQ2 | * | 0 | 0 | * | 1 | 1 | * |
| OUTPUT | GAn | 1 | 1 | 1 | 1 | 0 | 0 | 0 |

FIG. 13D

< GBn OUTPUT >

| | | | | | | | | |
|---|---|---|---|---|---|---|---|---|
| INPUT | $\overline{\text{GATE B1}}$ | 0 | 0 | 1 | 1 | 0 | 1 | 0 |
| | $\overline{\text{GATE B2}}$ | 0 | 1 | 0 | 1 | 1 | 0 | * |
| LATCH DATA | Q3 | 0 | 0 | * | * | 0 | * | 1 |
| | RQ2 | * | 0 | 0 | * | 1 | 1 | * |
| OUTPUT | GBn | 1 | 1 | 1 | 1 | 0 | 0 | 0 |

FIG. 13E

< Gqn OUTPUT >

| | | | | | | | | | | | | | | | |
|---|---|---|---|---|---|---|---|---|---|---|---|---|---|---|---|
| INPUT | $\overline{\text{GATE C1}}$ | 0 | 0 | 0 | 0 | 1 | 1 | 1 | 1 | 0 | 0 | 0 | 0 | 1 | 1 | 1 |
| | $\overline{\text{GATE C2}}$ | 0 | 0 | 1 | 1 | 0 | 0 | 1 | 1 | * | 0 | 1 | 1 | 0 | 1 | 0 |
| | $\overline{\text{GATE C3}}$ | 0 | 1 | 0 | 1 | 0 | 1 | 0 | 1 | * | 1 | 0 | * | * | 0 | 1 |
| LATCH DATA | Q2 OR q2 | 0 | 0 | 0 | 0 | * | * | * | * | 1 | 0 | * | * | * | * | * |
| | Q3 OR q3 | * | * | 0 | 0 | 0 | 0 | * | * | * | * | * | 1 | 1 | * | * |
| | LQ2 OR RQ2 | * | 0 | 0 | * | * | 0 | 0 | * | * | 1 | 1 | * | * | 1 | 1 |
| OUTPUT | Gqn | 1 | 1 | 1 | 1 | 1 | 1 | 1 | 1 | 0 | 0 | 0 | 0 | 0 | 0 | 0 |

*: "0" OR "1"

MULTI POWER TYPE THERMAL HEAD

BACKGROUND OF THE INVENTION

This invention relates to a two-color printing thermal head capable of outputting appropriate, different heating temperatures at the same scanning time to a heat-sensitive substance for developing different colors in response to the heating temperatures, for example, and in particular to an art for giving high power a thermal head for high temperature and low power to a thermal head for low temperature for optimizing the print quality.

To print on heat-sensitive paper with a thermal head, in a related art, as shown in FIG. 8A, if print energy (temperature) is made higher than T0, printing is executed in a constant color, such as black, and if print energy is made lower than T0, the print density is reduced, thus the thermal head is not heated for a portion to be skipped in printing. That is, only operation control as to whether or not printing is to be executed depending on the presence or absence of data on one line is performed.

To perform this control, a thermal head provided with an additional history control circuit for limiting a temperature rise caused by heat accumulated in a thermal head substrate also exists for controlling the thermal head at a single temperature, namely, single energy in printing.

In recent years, multi-color heat-sensitive paper printed in black, for example, when printing is executed with a high-temperature thermal head and printed in red, for example, when printing is executed with a low-temperature thermal head has been manufactured. For example, it has been provided as product name MB-23 of Oji Paper Co. Ltd.(JP).

That is, thermal-sensitive paper of this kind develops red, for example, when the print energy (temperature) of a thermal head is T2 and black when the print energy of a thermal head is T1 (T2<T1), as shown in FIG. 8B. If the print energy is made higher than T1, a whitening phenomenon appears. Thermal-sensitive paper of this kind is available not only with a combination of red and black, but also any other color combination based on low and high print energy.

By the way, when such multi-color heat-sensitive paper is used for executing multi-color printing, for example, red and black printing on a scanning line L0, as shown in FIG. 9A, with a thermal head in a related art, for example, first a red print data portion needs to be transferred in the current amount corresponding to a low temperature, then again data transfer needs to be executed on the same scanning line L0 in the current amount corresponding to a high temperature.

To execute two-color (red and black) printing as shown in FIG. 9B, likewise a red print data portion is transferred in the current amount corresponding to a low temperature on scanning lines L1, L2, . . . , then data transfer is executed on the same scanning lines L1, L2, . . . in the current amount corresponding to a high temperature.

Thus, to handle two types of energy, data transfer is executed twice on one line and each type of energy is set. Since it is necessary to execute data transfer twice on one line, a problem of low print speed is involved.

To solve this problem, a thermal head for making it possible to set different types of energy on one line in one scanning as shown in FIG. 10 is proposed in U.S. patent application Ser. No. 09/538,283 filed Mar. 30, 2000 (Japanese Patent Application No. Hei 9-302728).

By the way, a control circuit of the thermal head controls high-energy portion data and low-energy portion data separately. Thus, if two types of input energy data are mixed, printing of the low-energy data cannot be executed on low-energy print dots because of the effect of the high energy side, and the print result becomes close to the high-energy side data. For example, the portion to be printed in red is actually printed in a color close to black.

To overcome such a problem, a thermal head adapted so as not to affect printout of low-energy data in the present or absence of high-energy print data in the proximity of print points as shown in FIG. 11 is also proposed in the Japanese laid open Patent Publication no. 11-208008, filed Aug. 3, 1999 (Japanese Patent Application No. Hei 10-12320).

According to the thermal heads as proposed in the above-mentioned U.S. patent application, as high energy printing control and low energy printing control can be very precisely executed, two-color data can be precisely printed even if the two-color data are mixed.

For example, as shown in FIG. 9A, in case a black character area B and a red character area R are respectively blocked on paper, the black area and the red area can be also definitely printed by the control circuit shown in FIGS. 10 or 11. However, when a dot of the low energy part exists in a part adjacent to a dot of the high energy part and before and after the dot in case a black character on a red background is printed as shown in FIG. 9B, that is, in case a red area R and a black area B are mixed, there is a detect that as printing of a low energy part is developed in color close to printing of a high energy part by the printing of the high energy part, a character and a pattern become indefinite. However, according to the art described above, as a bad effect which high energy data has upon low energy data can be also effectively controlled in case plural types of input energy data are mixed as shown in FIG. 9B, clear and precise printing is also enabled in the case shown in FIG. 9B.

A rewritable print medium, such as an "Aladdin card" (registered trademark) manufactured by Tokyo Magnetic Printing Co. Ltd.(JP), is available. When high energy is given to the rewritable print medium by a thermal head, the medium is printable, but when low energy is given, change is made to a different color and characters, etc., printed on the medium by high energy are erased and characters, graphics, etc., can be again written on the medium by giving high energy.

The control circuits shown in FIGS. 10 and 11 can also be used for such a medium. In this case, a STROBE1 signal is set so as to add high energy for printing and a STROBE2 signal is set so as to give low energy for erasing print characters, etc. In this case, q1, q2, and q3 become print erasure data for performing print erasure control. For the medium, it is very strict to set the range of low energy for erasing characters, etc. Thus, preferably the heat history control based on the presence or absence of q2, q3 described above, namely, heating control based on the print erasure data q2, q3 as well as the magnitude of the STROBE2 signal is added for making energy adjustments.

Thus, the control circuits can also be used with the thermal head for the rewritable medium.

FIG. 12 is an equivalent circuit diagram to the control circuit in FIG. 11 and FIGS. 13A to 13E are logic tables of the control circuit shown in FIG. 12. In FIG. 11, the diode 23 and q2 input to the NAND circuit 19 have OR relation, thus are shown equivalently as an OR circuit 115 in FIG. 12A. The output protection circuit 13 in FIG. 11 is omitted in FIG. 12A. Thus, FIG. 11 can be represented equivalently by FIG. 12A.

In FIG. 12A, numeral 100 denotes an FET, numeral 101 denotes an OR circuit, numerals 102 and 103 denote multi-input AND circuits, numeral 104 denotes an AND circuit, numeral 105 denotes a multi-input AND circuit, numerals 106 and 107 denote AND circuits, numerals 108, 109, 110, 111, 112, 113, and 114 denote NAND circuits, numerals 115, 116, and 117 denote OR circuits, numerals 118, 119, 120, and 121 denote EOR circuits, and numerals 122, 123, 124, 125, 126, 127, 128, 129, and 130 denote inverters.

FIG. 12B (1), (2), and (3) summarize the unique control portion in the print control range (high energy part), the effect portion of high energy on the print control range (low energy part), and the unique control portion in the print control range (low energy part) shown in FIG. 12D. Q1, Q2, Q3, and Q4 in FIG. 12A denote latch data and q1, q2, and q3 also denote latch data.

For example, if the thermal head consists of 64 dots, 64 circuits in FIG. 12A are provided, and n of each of a terminal DOn, GQn, GAn, and GBn of the AND circuit 104, and Gqn of the multi-input AND circuit 105 indicates that a plurality of such circuits exist.

As shown in FIG. 13A, if STROBE q is "0" and latch data Q1 and q1 are "0" and "1" respectively as input and output of the multi-input AND circuit 105 (Gqn) is "1" as in-circuit output, the terminal DOn outputs ON regardless of whether STROBE Q is "1" or "0" and regardless of whether output of the AND circuit 104 (GQn) is "1" or "0." Asterisk * denotes either "0" or "1." If STROBE Q is "0" and STROBE q is "1" and latch data Q1 and q1 are "0" and "0" respectively, the terminal DOn outputs OFF regardless of whether output of the AND circuit 104 (GQn) is "1" or "0" and regardless of whether output of the multi-input AND circuit 105 (Gqn) is "1" or "0." In addition, the terminal DOn outputs ON or OFF in response to the "1" or "0" state of each of STROBE Q, STROBE q, Q1, q1, GQn, and Gqn shown in FIG. 13A.

The AND circuit 104 (GQn) outputs "1" or "0" in response to the "1" or "0" state of each of the AND circuit 106 (GAn) and the AND circuit 107 (GBn) as in-circuit output, as shown in FIG. 13B. The AND circuit 106 (GAn) outputs "1" or "0" in response to the "1" or "0" state of each of input GATE A1 and GATE A2 and latch data Q2 and LQ2, as shown in FIG. 13C.

The AND circuit 107 (GBn) outputs "1" or "0" in response to the "1" or "0" state of each of input. GATE B1 and GATE. B2 and latch data Q3 and RQ2, as shown in FIG. 13D.

The multi-input AND circuit 105 (Gqn) outputs "1" or "0" in response to the. "1" or "0" state of each of input GATE C1, GATE C2, and GATE C3 and latch data Q2 or q2, Q3 or q3, and LQ2 or RQ2, as shown in FIG. 13E.

By the way, with the thermal head in the related art shown in FIG. 10, FIG. 11, etc., the magnitude of print energy is set depending on the duration of applying the electric current flowing into the heating terminal. That is, it is determined by the magnitude of STROBE1, STROBE2 in FIG. 10, FIG. 11, and the current value, namely, unit power is the same.

Specifically, the heating value of the thermal head in unit time is made constant and large and small print energies are determined by the heating duration. That is, letting the heating value in the unit time be W, resistance of the thermal head be r0, and applied voltage be V, the heating value of the thermal head in the unit time, W, is determined as $W=V^2/r$. To use the thermal head in a high energy state, the thermal head is heated only for time t2, namely, by W·t2; to use the thermal head in a low energy state, the thermal head is heated only for time t1 (t2>t1), namely, by W·t1.

That is, in the thermal head making it possible to set different large and small energies in one scanning based on the magnitude of a strobe signal described alter, the magnitude of the print energy (large or small) is set only based on the duration of heating the heater of the thermal head with the same heating value in the unit time applied.

Therefore, if the heating time is shortened to lessen the print energy, the heating value in the unit time is the same as that in the high energy state, thus insufficient color development may exist depending on the nature of heat-sensitive paper. When the thermal head is used with rewritable paper with characters, etc., printed in a high energy state, erased by giving low-energy heat from the thermal head is used, the characters cannot sufficiently be erased because of the short time in some cases.

SUMMARY OF THE INVENTION

It is therefore an object of the invention to provide a thermal head capable of lessening print energy if the application time is made longer than the previous application time.

Particularly, it is provided a thin-film multi power type thermal head comprising an added resistor connected in series to a heating resistor wherein to use the thermal head in a high energy state, only the heating resistor is energized and to use the thermal head in a low energy state, the resistors are energized with the added resistor connected in series to the heating resistor, namely, to provide a thin-film thermal head capable of giving different energizes if the same heating element uses the same power source.

According to a first aspect of the invention, a multi power type thermal head comprising a heating element for producing heat with different energies, an added resistor being connected to the heating element, first switch means for controlling the heating element in an operation state or a non-operational state, second switch means for controlling the heating element and the added resistor in an operation state or a non-operational state, first strobe signal input means for causing the first switching means to perform heating control of the heating element corresponding to first energy, second strobe signal input means for causing the second switching means to perform heating control of the heating element corresponding to second energy, first heating time control means for performing print control with the first energy and controlling the heating time of the heating element based on a first strobe signal in response to the presence or absence of print data in the print control range of objective print data, and second heating time control means for performing print control with the second energy and controlling the heating time of the heating element based on a second strobe signal in response to the presence or absence of print data in the print control range of objective print data.

Preferably, in the multi power type thermal, the heating element and the added resistor are made of thin-film resistance formed on the same insulating substrate.

The following selection can be controlled: The added resistor is connected to the heating element and only the heating element is placed in the. operational state with high energy by the first switching means and the second switching means or the heating element and the added resistor are connected in series and placed in the operational state with low energy. Thus, a-dual power type thermal head that can be not only controlled in the high energy state and the low energy state, but also operated for a long time in the low energy state can be provided.

Since the heating element and the added resistor are made of the same thin-film resistance, a small-sized dual power type thermal head with a high resolution can be provided. according to a second aspect of the invention, multi power type thermal head comprising a thin-film resistance layer comprising a heating resistance part formed on a glaze layer provided partially on an insulating substrate and an added resistance part formed on the insulating substrate, the heating resistance part and the added resistance part being formed integrally, a first electrode connection part being placed on the thin-film resistance layer and connected to first switching means, and a second electrode connection part being placed on the thin-film resistance layer and connected to second switching means.

Further, a multi power type thermal head comprising a thin-film resistance layer comprising a heating resistance part formed on a glaze layer provided partially on an insulating substrate and an added resistance part formed on the insulating substrate, the heating resistance part and the added resistance part being formed integrally, a first electrode connection part being placed on the thin-film resistance layer and connected to first switching means, a second electrode connection part being placed on the thin-film resistance layer and connected to second switching means, first strobe signal input means for causing the first switching means to perform heating control of the heating resistance part with first energy, and second strobe signal input means for causing the second switching means to perform heating control of the heating resistance part with second energy, in that the heating resistance part and the added resistance part are connected in series and energized based on input of a second strobe signal and the unit heating value of the heating resistance part is smaller than that of heat produced in the heating resistance part based on input of a first strobe signal.

Since the thin-film resistor comprising the heating resistance part and the added resistance part formed integrally is formed on the insulation substance and the glaze layer is formed below the heating resistance part, heat produced in the heating resistance part is accumulated in the glaze layer and heat-sensitive paper can be heated accurately. In addition, heat produced in the added resistance part can be well radiated via the insulating substrate on which the glaze layer is not formed. Thus, although the heating resistance part and the added resistance part are formed integrally, occurrence of the adverse effect caused by heating the added resistance part can be suppressed.

Since the heating resistance part and the added resistance part are energized with the heating resistance part and the added resistance part connected in series based on input of a second strobe signal, the unit heating value of the heating resistance part can be made smaller than that in the high energy state in which only the heating resistance part is energized solely. Thus, a multi power type thermal head suitable for heat-sensitive paper whose characteristic in the low energy state requires a small unit heating value can be provided.

BRIEF DESCRIPTION OF THE DRAWINGS

FIGS. 13A to 13E are logic tables of the control circuit shown in FIG. 12;

DETAILED DESCRIPTION OF THE PREFERRED EMBODIMENTS

Figure 1A:
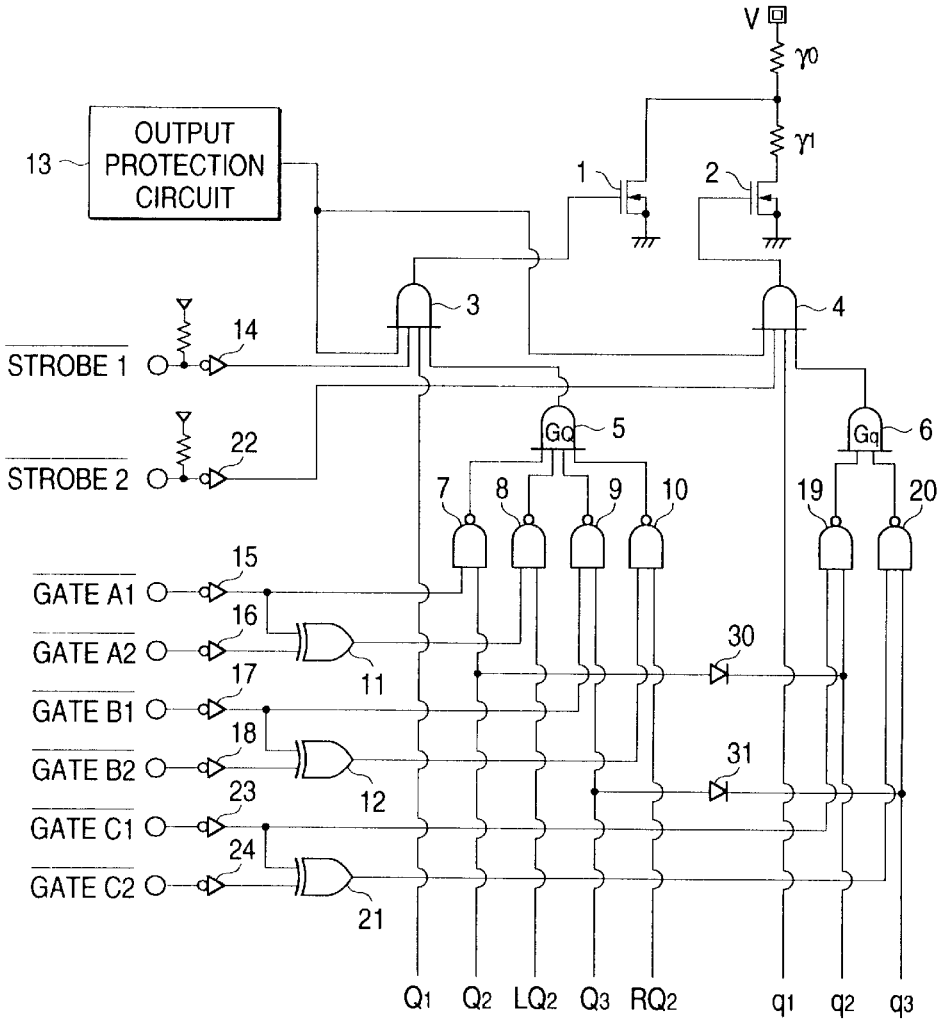
FIGS. 1A to 1C show a control circuit per dot of a thermal head in the invention.
Figure 1B:
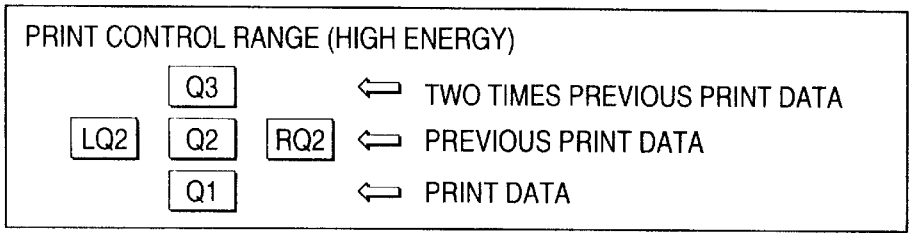
Figure 1C:
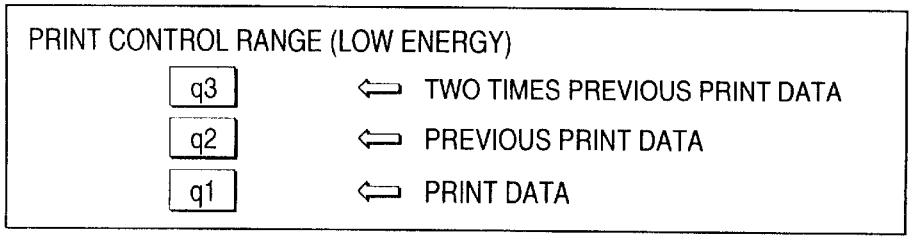
Figure 3:
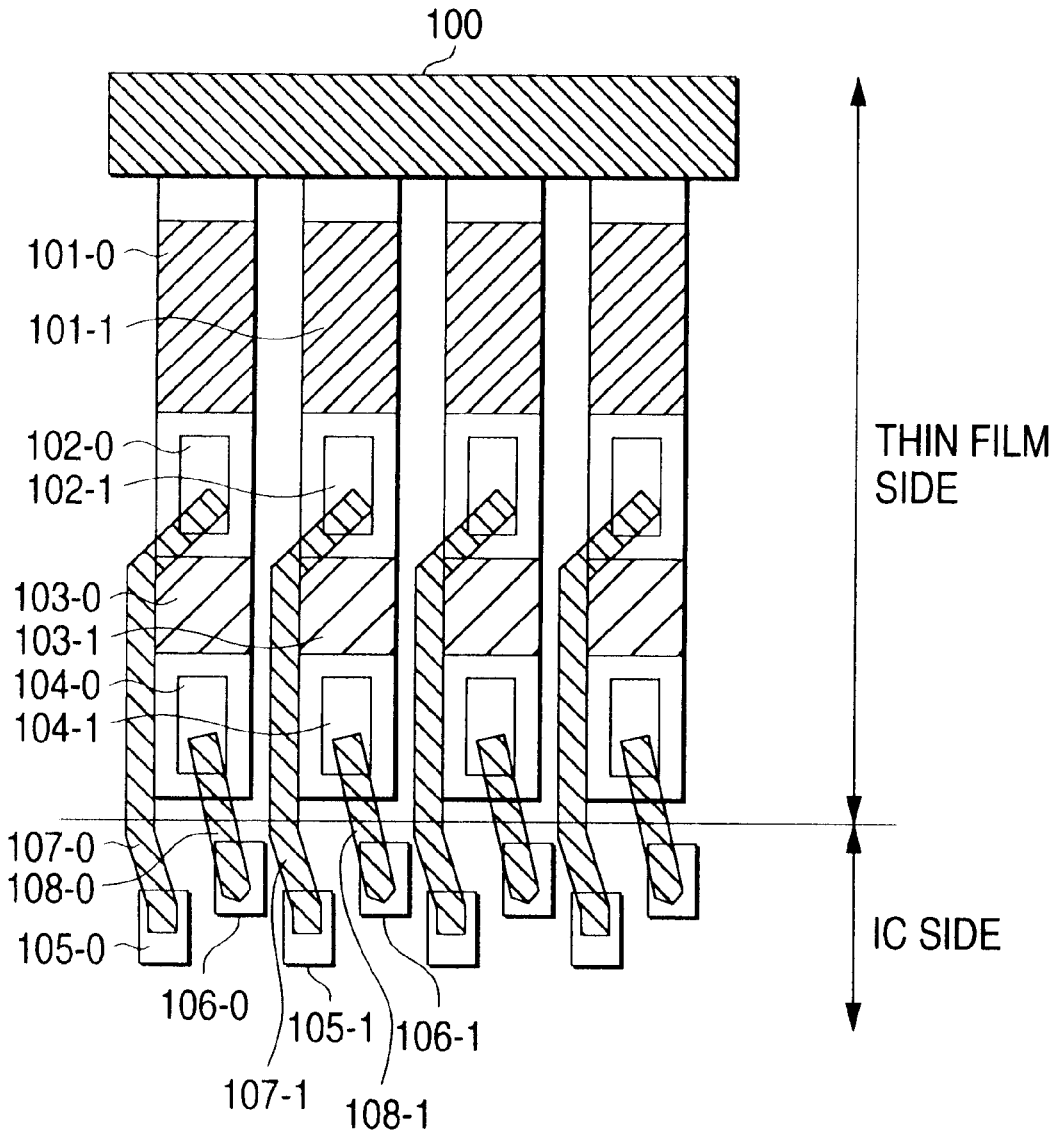
FIG. 3 is a drawing to show the configuration of the head part of a dual power type thermal head of the invention.
Figure 4A:
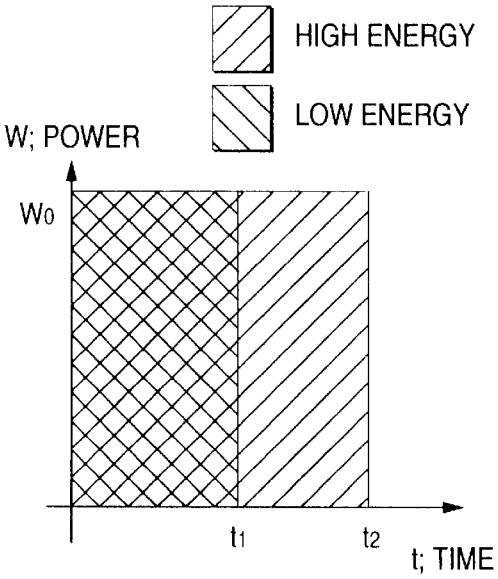
FIGS. 4A to 4C are heating energy comparison drawings of an example in a related art with the invention.
Figure 4B:
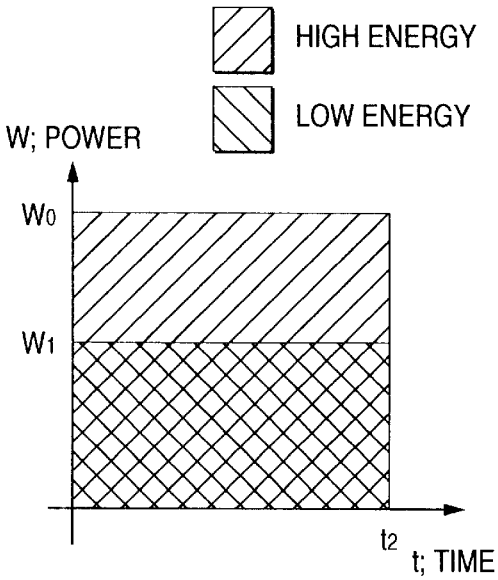

A first embodiment of the invention will be discussed with reference to FIGS. 1 to 5. FIGS. 1A to 1C show a control circuit per dot of a thermal head of the first embodiment of the invention. FIG. 2 is a schematic representation of the operation of the control circuit in FIG. 1A. FIG. 3 is a drawing to show the configuration of the head part of a dual power type thermal head of the invention. FIGS. 4A and 4B are heating energy comparison drawings of an example in a related art with the invention. FIG. 5 shows one embodiment of the invention.

Figure 8A:
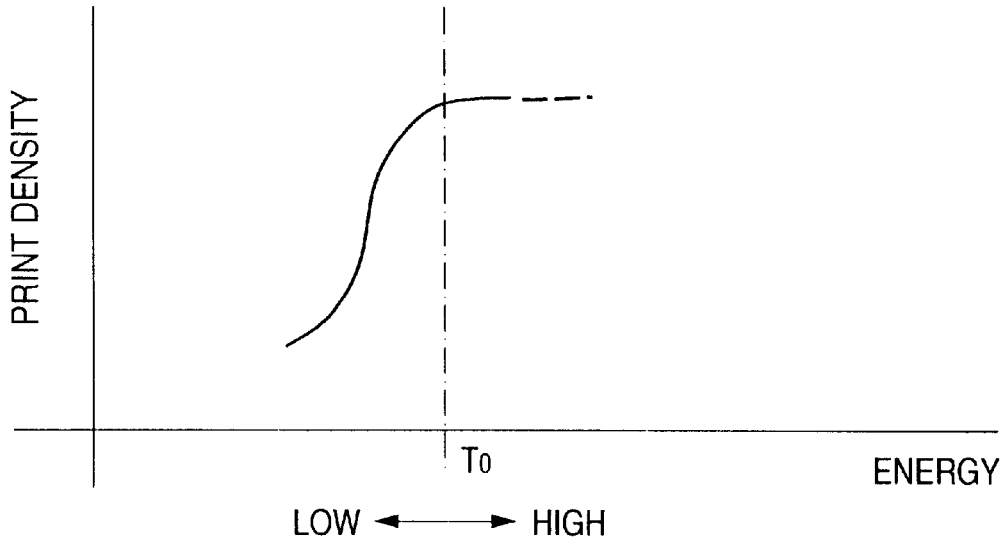
FIGS. 8A and 8B schematic representations of print energy for heat-sensitive paper.
Figure 8B:
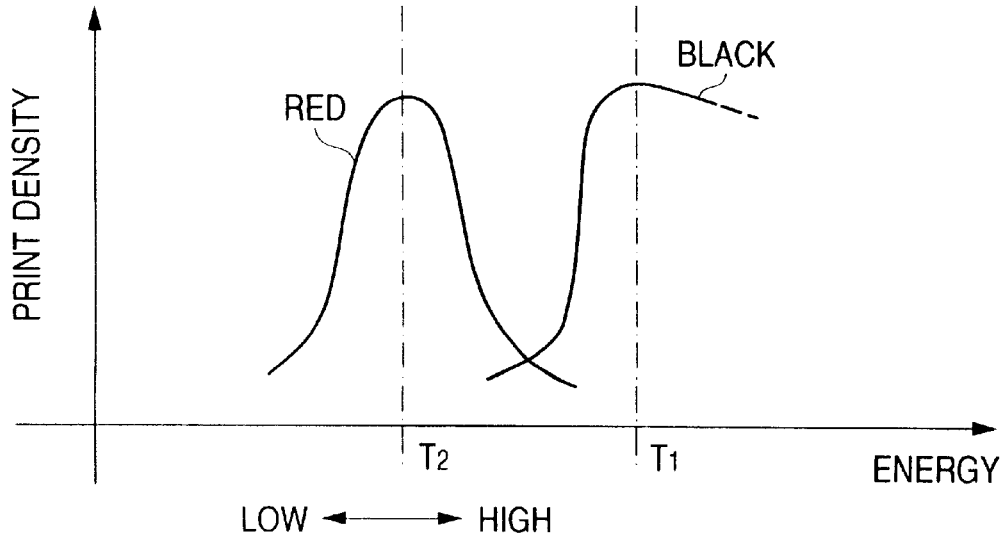

In the invention, as shown in FIG. 1A, an added resistor r1 is connected in series to a heating resistor r0 of a thermal head and as shown in T1 in FIG. 8B, to use the thermal head on the high print energy side, an FET 1 is turned on and an FET 2 is turned off for applying terminal voltage V. only to the heating resistor r0 for heating the heating resistor r0. As shown in T2 in FIG. 8B, to use the thermal head on the low print energy side, the FET 1 is turned on and the FET 2 is turned off and the heating resistor r0 and the added resistor rl are connected in series and terminal voltage V1 is applied to the series circuit for heating the heating resistor r0.

Figure 4C:
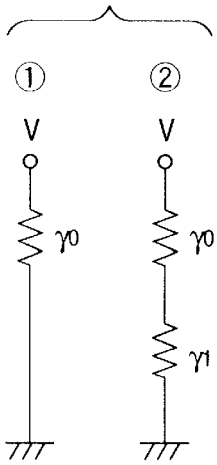
Figure 5:
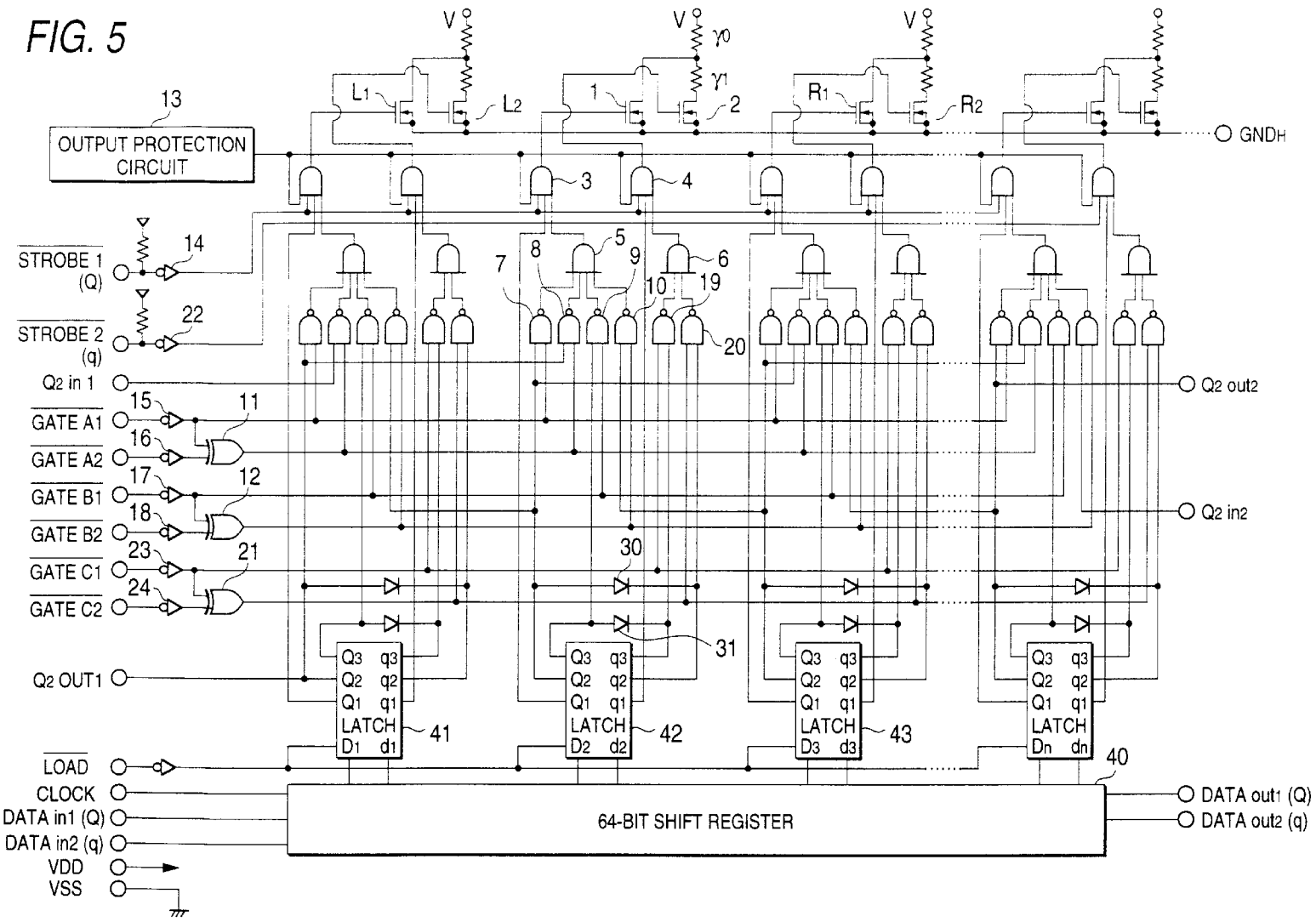
FIG. 5 shows one embodiment of the invention.

Thus, if the FET 1 is turned on and the FET 2 is turned off and the terminal voltage V is applied only to the heating resistor r0 as shown in FIG. 4C (1), power W0 generated on the heating resistor r0 becomes as in the following expression (1):

$$W0=V^2/r0 \quad (1)$$

If the FET 1 is turned off and the FET 2 is turned on and the terminal voltage V is applied to the series circuit of the heating resistor r0 and the added resistor rl as shown in FIG. 4C (2), power W1 generated on the heating resistor r0 becomes as in the following expression (2):

$$W1=(V\cdot r0/(r0+r1))^2/r0 \quad (2)$$

Thus, it is seen from expression (2) that the power W1 becomes lower than the power W0 in the presence of the added resistor r1.

In the thermal head proposed in (Japanese Patent Application No. Hei 10-12320, as shown in FIG. 4A, the power W0 applied in the unit time from the heating resistor to heat-sensitive paper., namely, the unit power is the same regardless of the high or low energy state; in the high energy state, the heating time t2 is set longer than the heating time t1 in the low energy state, whereby the applied energy to heat-sensitive paper in the high energy state becomes W0·t2 and is made larger by the heating time difference t2−t1 than the applied energy W0·t1 in the low energy state.

In contrast, in the invention, as shown in FIG. 4B, the power applied in the unit time from the heating resistor to heat-sensitive paper is W0 in the high energy state, but becomes w1 in the low energy state, which is lower than W0. Therefore, if the heating time is set to t2 in both the states as shown in FIG. 4B, the applied energy to heat-sensitive paper in the high energy state becomes W0·t2 and becomes larger than the applied energy in the low energy state, W1·t2. The unit heating value in the heating resistance is thus adjusted, whereby the low energy state can be entered. In the description with reference to FIG. 4B, the heating time in the high energy state is the same as that in the low energy state, but they need not be the same; the different heating times can be set appropriately depending on the nature of paper.

The first embodiment of the invention shown in FIG. 1A will be discussed. In FIG. 1A, numerals 1 and 2 denote FETs, numerals 3, 4, and 5 denote multi-input AND circuits, numeral 6 denotes an AND circuit, numerals 7 to 10 denote NAND circuits, numerals 11 and 12 denote EOR (exclusive-OR) circuits, numeral 13 denotes an output protection circuit, numerals 14 to 18 denote inverters, numerals 19 and 20 denote NAND circuits, numeral 21 denotes EOR circuit, numerals 22 to 24 denote inverters, numerals 30 and 31 denote diodes, r0 denotes a heating resistor, and rl denotes an added resistor.

When the IC forming the thermal head operates normally, the output protection circuit 13 outputs "1" to the multi-input AND circuits 3 and 4.

Signals indicating the presence or absence of print dots Q1, Q2, Q3, LQ2, and RQ2 in a high energy part shown in FIG. 1B are input as signals Q1, Q2, Q3, LQ2, and RQ2 shown in FIG. 1A, and signals indicating the presence or absence of print dots q1, q2, and q3 in a low energy part shown in FIG. 1C are input as signals q1, q2, and q3 shown in FIG. 1A.

A strobe signal STROBEL is provided for heating the thermal head as the high energy part for printing on paper in black, and a strobe signal STROBE2 is provided for heating the thermal head as the low energy part for printing on paper in red, for example.

Now, when the print dot Q1 shown in FIG. 1B is printed, if print data does not exist in Q2, Q3, LQ2, or RQ2, they are "0" and the NAND circuits 7 to 10 output all "1," thus the multi-input AND circuits 5 and 3 output both "1," causing the FET 1 to be turned on only for time T1 determined by the strobe signal STROBE1 for heating the heating resistor r0 of the thermal head.

However, if print data exists in at least one of Q2, Q3, LQ2, and RQ2, considering the heat accumulation effect, as described later, the multi-input AND circuit 5 outputs "0" only for the time controlled based on gate signal A1, B1, A2, B2 for controlling so that the output time of "1" of the multi-input AND circuit 3 based on the strobe signal STROBEL becomes shorter than the time T1 and controlling so that the heat-sensitive paper heating energy of the thermal head in the strobe signal STROBEL becomes equal.

When the print dot q1 shown in FIG. 1*c* is printed, if print data does not exist in q2 or q3, they are "0" and the NAND circuits 19 and 20 output both "1," thus the AND circuit 6 and the multi-input AND circuit 4 output both "1," causing the FET 2 to be turned on only for time T2 determined by the strobe signal STROBE2 for heating the heating resistor r0 with the heating resistor r0 and the added resistor r1 connected in series.

However, if print data exists in at least one of q2 and q3, considering the heat accumulation effect, as described later, the AND circuit 6 outputs "0" only for the time controlled based on gate signal C1, C2 for controlling so that the output time of "1" of the multi-input AND circuit 4 based on the strobe signal STROBE2 becomes shorter than the time T2 and controlling so that the heat-sensitive paper heating energy of the thermal head in the strobe signal STROBE2 becomes equal.

Figures 2A, 2B:
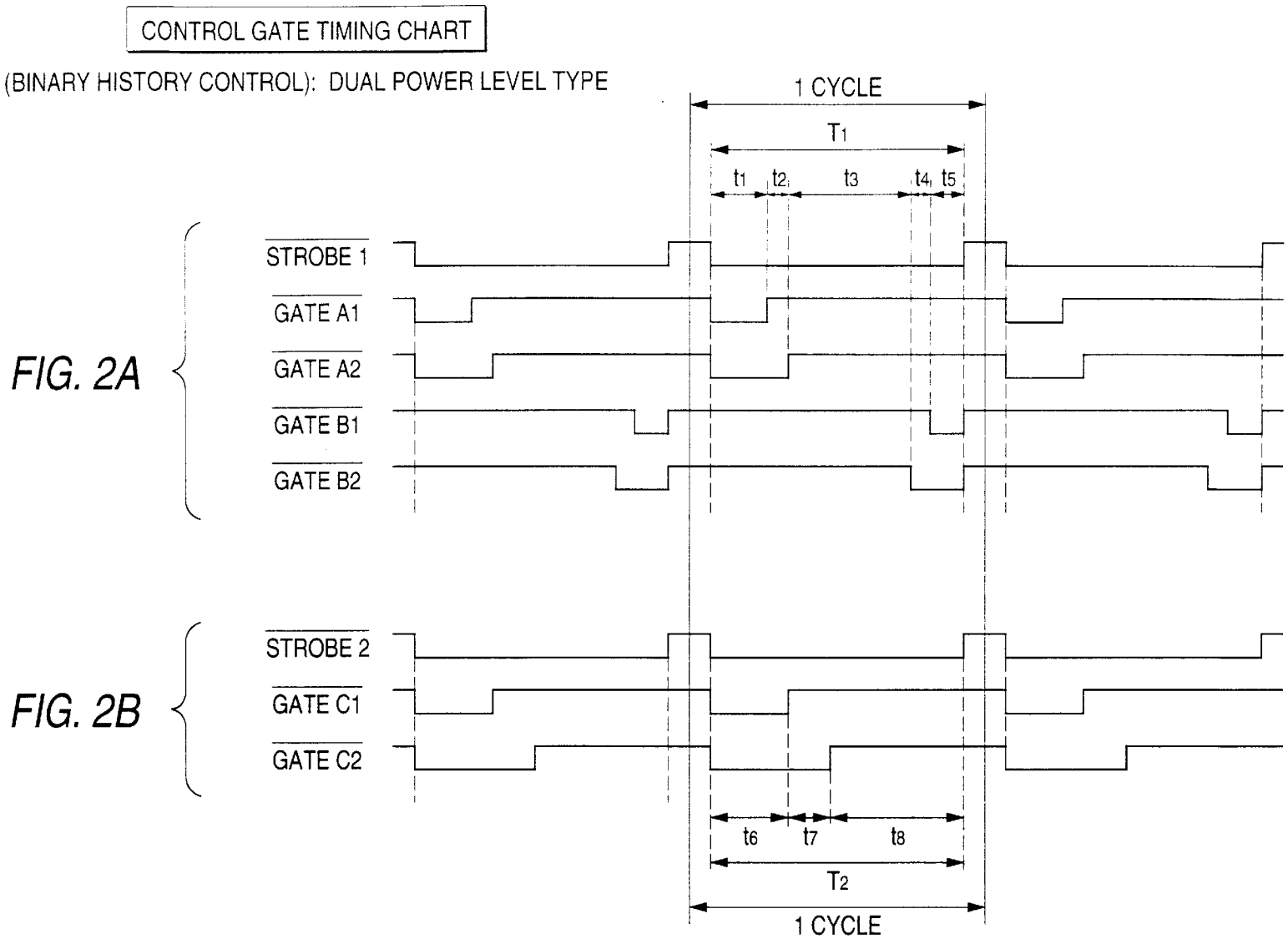
FIGS. 2A and 2B are charts to describe control signals applied to the control circuit in FIG. 1A.

The control signals shown in FIGS. 2A and 2B are output by a control signal output circuit (not shown) in the same period S.

The control signals shown in FIG. 2A are control signals for controlling the thermal head in the high energy state, and the control signals shown in FIG. 2B are control signals for controlling the thermal head in the low energy state.

If a print dot exists only in the print dot Q1 in the print control range shown in FIG. 1B, the STROBEL signal turns on the FET 1 only for the time T1 for heating the thermal head connected to the FET 1 only for the time T1; the STROBE1 signal is low only for the time T1 as shown in FIG. 2A.

A GATE A1 signal falls at the same time as the STROBE1 signal, and rises in time t1.

A GATE A2 signal falls at the same time as the STROBEL signal, and rises in time (t1+t2).

A GATE B1 signal falls in time (t1+t2+t3+t4) after the STROBE1 signal falls, and rises at the same time as the STROBE1 signal in time t5.

A GATE B2 signal falls in the time (t1+t2+t3) after the STROBE1 signal falls, and rises at the same time as the STROBE1 signal in the time (t4+t5).

If a print dot exists only in the print dot q1 in the print control range shown in FIG. 1C, the STROBE2 signal turns on the FET 1 only for the time T2 for heating the thermal head connected to the FET 1 only for the time T2 (T2<T1); the STROBE2 signal falls at the same time as the STROBEL signal and is low only for the time T2 as shown in FIG. 2B.

A GATE C1 signal falls at the same time as the STROBE2 signal, and rises in time t6.

A GATE C2 signal falls at the same time as the STROBE2 signal, and rises in time (t6+t7).

The times T1, T2, and t1 to t8 can be set appropriately in response to the characteristics of paper.

First, heat history control will be discussed with reference to FIGS. 1 and 2 about the case where print data exists as described below for print dots Q1 to Q3, LQ2, and RQ2 in the print control range shown in FIG. 1B, namely, the high energy portion and for print dots q1 to q3 in the print control range shown in FIG. 1C, namely, the low energy portion.

Assuming that Q1 is the objective print dot, Q2 denotes a print dot on the line immediately preceding the line of Q1 and Q3 denotes a print dot on the line immediately preceding the line of Q2. LQ2 denotes a print dot on the left of Q2 on the line immediately preceding the line of Q1 and RQ2 denotes a print dot on the right of Q2 on the line immediately preceding the line of Q1.

Assuming that q1 is the objective print dot, q2 denotes a print dot on the line immediately preceding the line of q1 and q3 denotes a print dot on the line immediately preceding the line of q2.

(1) When print data exists only in print dot Q1.

If print data exists only in the objective print dot Q1 and does not exist in Q2, Q3, LQ2, or RQ2 in the print control range shown in FIG. 1B, Q1 is set to "1," Q2 to "0," Q3 to "0," LQ2 to "0," and RQ2 to "0" in FIG. 1A.

As "0" is input, each of the NAND circuits 7 to 10 outputs "1," thus the multi-input AND circuit 5 outputs "1." At this time, if the thermal head is normal, "1" is output from the output protection circuit 13. Since Q1 is "1" and the STROBEL signal as shown in FIG. 2A is transferred to the inverter 14, "1" is output from the multi-input AND circuit 3 only for the time T1 shown in FIG. 2A. At this time, q1 is "0," thus the multi-input AND circuit 4 outputs "0."

Thus, "1" output from the multi-input AND circuit 3 is input to the FET 1. If print data exists in the print dot Q1 and does not exist in Q2, Q3, LQ2, or RQ2, in the end, the OR circuit 2 applies "1" to the FET 1 to turn on the FET 1 only for the time T1 for heating the heating resistor r0 of the thermal head connected to the FET 1 only for the time T1.

(2) When print data exists in print dots Q1 and Q2

When print data exists in the objective print dot Q1 and the print dot Q2 on the line immediately preceding the line of Q1, in FIG. 1A, "1" is applied to Q1 and Q2 and "0" is applied to Q3, LQ2, and RQ2, whereby each of the NAND circuits 8 to 10 outputs "1."

At this time, the inversion signal of the GATE A1 signal shown in FIG. 2A provided by the inverter 15 and Q2 set to 1 are applied to the NAND circuit 7, which then outputs "0" only for the time t1 in FIG. 2 and "1" otherwise. Therefore, the multi-input AND circuit 5 outputs "1" for the time (t2+t3+t4+t5) resulting from subtracting the time t1 from the time T1 shown in FIG. 2 and the FET 1 is also turned on only for the time for heating the heating resistor r0 of the thermal head connected to the FET 1 only for the time (T1−t1).

(3) When print data exists in print dots Q1 and LQ2

When print data exists in the objective print dot Q1 and the print dot LQ2 on the left of Q2 on the line immediately preceding the line of Q1, in FIG. 1A, "1" is applied to Q1 and LQ2 and "0" is applied to Q2, Q3, and RQ2, whereby each of the NAND circuits 7, 9, and 10 outputs "1."

At this time, LQ2 set to 1 and output of the EOR circuit 11 are input to the NAND circuit 8. The inversion signal of the GATE A1 signal shown in FIG. 2A provided by the inverter 15 and the inversion signal of the GATE A2 signal shown in FIG. 2A provided by the inverter 16 are applied to the EOR circuit 11, which then outputs "1" only for the time t2 shown in FIG. 2 and "0" otherwise. Thus, the NAND circuit 8 outputs "0" only for the time t2 and "1" otherwise.

Therefore, the multi-input AND circuit 3 outputs "1" for the time (t1+t3+t4+t5) resulting from subtracting the time t2 from the time T1 shown in FIG. 2 and the FET 1 is also turned on only for the time for heating the heating resistor r0 of the thermal head connected to the FET 1 only for the time (T1−t2).

(4) When print data exists in print dots Q1 and RQ2

When print data exists in the objective print dot Q1 and the print dot RQ2 on the right of Q2 on the line immediately preceding the line of Q1, in FIG. 1A, "1" is applied to Q1 and RQ2 and "0" is applied to Q2, Q3, and LQ2, whereby each of the NAND circuits 7 to 9 outputs "1."

At this time, RQ2 set to 1 and output of the EOR circuit 12 are input to the NAND circuit 10. The inversion signal of the GATE B1 signal shown in FIG. 2A provided by the inverter 17 and the inversion signal of the GATE B2 signal shown in FIG. 2A provided by the inverter 18 are applied to the EOR circuit 12, which then outputs "1" only for the time t4 shown in FIG. 2 and "0" otherwise. Thus, the NAND circuit 10 outputs "0" only for the time t4 and "1" otherwise.

Therefore, the multi-input AND circuit 3 outputs "1" for the time (t1+t2+t3+t5) resulting from subtracting the time t4 from the time T1 shown in FIG. 2 and the FET 1 is also turned on only for the time for heating the heating resistor r0 of the thermal head connected to the FET 1 only for the time (T1−t4).

(5) When print data exists in print dots Q1 and Q3

When print data exists in the objective print dot Q1 and the print dot Q3 on the line immediately preceding the line of Q2 on the line immediately preceding the line of Q1, in FIG. 1A, "1" is applied to Q1 and Q3 and "0" is applied to Q2, LQ2, and RQ2, whereby each of the NAND circuits 7, 8, and 10 outputs "1."

At this time, Q3 set to 1 and the inversion signal of the GATE B1 signal shown in FIG. 2A provided by the inverter 17 are applied to the NAND circuit 9, which then outputs "0" only for the time t5 shown in FIG. 2A and "1" otherwise.

Therefore, the multi-input AND circuit 3 outputs "1" for the time (t1+t2+t3+t4) resulting from subtracting the time t5 from the time T1 shown in FIG. 2 and the FET 1 is also turned on only for the time for heating the heating resistor r0 of the thermal head connected to the FET 1 only for the time (T1−t5).

(6) When print data exists in print dots Q1, Q2, and Q3

When print data exists in the objective print dot Q1, the print dot Q2 on the line immediately preceding the line of Q1, and the print dot Q3 on the line immediately preceding the line of Q2, in FIG. 1A, "1" is applied to Q1, Q2, and Q3 and "0" is applied to LQ2 and RQ2, whereby each of the NAND circuits 8 and 10 outputs "1."

At this time, Q2 set to 1 and the inversion signal of the GATE A1 signal shown in FIG. 2A provided by the inverter 15 are applied to the NAND circuit 7, which then outputs "0" only for the time t1 shown in FIG. 2 and "1" otherwise. Q3 set to 1 and the inversion signal of the GATE B1 signal shown in FIG. 2A provided by the inverter 17 are applied to the NAND circuit 9, which then outputs "0" only for the time t5 shown in FIG. 2 and "1" otherwise.

Therefore, the multi-input AND circuit 3 outputs "1" for the time (t2+t3+t4) resulting from subtracting the times t1 and t5 from the time T1 shown in FIG. 2 and the FET 1 is also turned on only for the time for heating the heating resistor r0 of the thermal head connected to the FET 1 only for the time (T1−t1−t5).

(7) When print data exists in print dot Q1 and some of print dots Q2, Q3, LQ2, and RQ2

When print data exists in the objective print dot Q1 and some of print dots Q2, Q3, LQ2, and RQ2, for example, Q2 and LQ2, Q3 is 0 and RQ2 is 0, thus each of the NAND circuits 9 and 10 outputs "1."

At this time, as shown in (2) above, the inversion signal of the GATE A1 signal shown in FIG. 2A provided by the inverter 15 and Q2 set to 1 are applied to the NAND circuit 7, which then outputs "0" only for the time t1 shown in FIG. 2.

As shown in (3) above, LQ2 set to 1 and output of the EOR circuit 11 are input to the NAND circuit 8. The inversion signal of the GATE A1 signal shown in FIG. 2A provided by the inverter 15 and the inversion signal of the GATE A2 signal shown in FIG. 2A provided by the inverter 16 are applied to the EOR circuit 11, which then outputs "1" only for the time t2 shown in FIG. 2 and "0" otherwise. Thus, the NAND circuit 8 outputs "0" only for the time t2.

Therefore, when print data exists in Q2 and LQ2, the multi-input AND circuit 5 outputs "0" only for the time of the sum of the time t1 for which the multi-input AND circuit 5 outputs "0" when data exists in the objective print dot Q1 and the print dot Q2 and the time t2 for which the multi-input AND circuit 5 outputs "0" when data exists in the objective print dot Q1 and the print dot LQ2, (t1+t2), and the heating resistor r0 of the thermal head connected to the FET 1 is heated only for the time (T1−t1−t2).

That is, when print data exists in the objective print dot Q1 and some of print dots Q2, Q3, LQ2, and RQ2, the multi-input AND circuit 5 outputs "0" only for the time of the sum of the times for which the multi-input AND circuit 5 outputs "0" when data exists in the objective print dot Q1 and other print dots as described in (2) to (5) above, and the heating resistor r0 of the thermal head connected to the FET 1 is heated only for the time resulting from subtracting the sum of the times from T1.

For example, when print data exists in all of Q1, Q2, Q3, LQ2, and RQ2, the multi-input AND circuit 5 outputs "1" only for the time of T1−(t1+t2+t4+t5)=t3 for heating the heating resistor r0 of the thermal head connected to the FET 1 only for the time t3.

(8) When print data exists only in print dot q1

If print data exists only in the objective print dot q1 and does not exist in g2 or q3 in the print control range shown in FIG. 1C, q1 is set to "1," q2 to "0," and q3 to "0" in FIG. 1A.

As q2 is "0" and q3 is "0," each of the NAND circuits 19 and 20 outputs "1," thus the multi-input AND circuit 6 outputs "1." At this time, if the thermal head is normal, "1" is output from the output protection circuit 13. Since q1 is "1" and the STROBE2 signal as shown in FIG. 2B is transferred to the inverter 22, "1" is output from the multi-input AND circuit 4 only for the time T2 shown in FIG. 2B. At this time,Q1 is "0," thus the multi-input AND circuit 3 outputs "0."

Thus, "1" output from the multi-input AND circuit 4 is input to the FET 2. If print data exists in the print dot q1 and does not exist in q2 or q3, in the end, "1" is applied to the FET 2 to turn on the FET 2 only for the time T2 for heating the heating resistor r0 of the thermal head connected to the FET 2 only for the time T2.

(9) When print data exists in print dots q1 and q2

When print data exists in the objective print dot q1 and the print dot q2 on the line immediately preceding the line of ql, in FIG. 1A, "1" is applied to q1 and q2 and "0" is applied to q3, whereby the NAND circuit 20 outputs "1."

At this time, the inversion signal of the GATE C1 signal shown in FIG. 2B provided by the inverter 23 and q2 set to 1 are applied to the NAND circuit 19, which then outputs. "0" only for the time t6 in FIG. 2 and "1" otherwise. Therefore, the AND circuit 6 outputs "1" for the time resulting from subtracting the time t6 from the timeT2 shown in FIG. 2 (t7+t8) and the multi-input AND circuit 4 and the OR circuit 2 also output "1" only for the time (t7+t8). Thus, the FET 2 is also turned on only for the time for heating the heating resistor r0 of the thermal head connected to the FET 2 with the heating resistor r0 and the added resistor r1 connected in series only for the time (T2−t6).

(10) When print data exists in print dots q1 and q3

When print data exists in the objective print dot q1 and the print dot q3 immediately preceding the print dot q2 immediately preceding the print dot q1, in FIG. 1A, "1" is applied to q1 and q3 and "0" is applied to q2, whereby the NAND circuit 19 outputs "1."

At this time, q3 set to 1 and output of the EOR circuit 21 are input to the NAND circuit 20. The inversion signal of the GATE C1 signal shown in FIG. 2B provided by the inverter 23 and the inversion signal of the GATE C2 signal shown in FIG. 2B provided by the inverter 24 are applied to the EOR circuit 21, which then outputs "1" only for the time t7 shown in FIG. 2 during which both the signals do not match in state, and "0" otherwise.

Therefore, the AND circuit 6 outputs "1" for the time (t6+t8) resulting from subtracting the time t7 from the time T2 shown in FIG. 2 and the multi-input AND circuit 4 and the OR circuit 2 also output "1" only for the time (t6+t8). Thus, the FET 2 is also turned on only for the time for heating the heating resistor r0 of the thermal head connected to the FET 2 with the heating resistor r0 and the added resistor r1 connected in series only for the time (T2−t7).

(11) When print data exists in print dots q1, q2, and q3

When print data exists in the objective print dot q1, the print dot q2 immediately preceding the print dot q1, and the print dot q3 immediately preceding the print dot q2, in FIG. 1A, "1"is applied to q1, q2, and q3 in FIG. 1A.

At this time, as described in (9) above, the inversion signal of the GATE C1 signal shown in FIG. 2B provided by the inverter 23 and q2 set to 1 are applied to the NAND circuit 19, which then outputs "0" only for the time t6 shown in FIG. 2.

As described in (10) above, q3 set to 1 and output of the EOR circuit 21 are input to the NAND circuit 20. At this time, the inversion signal of the GATE C1 signal shown in FIG. 2B provided by the inverter 23 and the inversion signal of the GATE C2 signal shown in FIG. 2B provided by the inverter 24 are applied to the EOR circuit 21, which then outputs "1" only for the time t7 shown in FIG. 2 during which both the signals do not match in state, and "0" otherwise. Thus, the NAND circuit 20 outputs "0" only for the time t7 and "1" otherwise.

Therefore, the AND circuit 6 outputs "1" for the time resulting from subtracting the times t6 and t7 from the time T2 shown in FIG. 2, namely, t8 and the multi-input AND circuit 4 and the OR circuit 2 also output "1" only for the time t8. Thus, the FET 2 is also turned on only for the time t8=T2−(t6+t7) for heating the heating resistor r0 of the thermal head connected to the FET 2 with the heating resistor r0 and the added resistor r1 connected in series only for the time T2−(t6+t7).

Next, the control operation will be discussed for the case where print data exists in q1 in the low energy part, does not exist in q2 or q3 in the low energy part, and exists in Q2 or Q3 in the high energy part, and the like. Because of the nature of print data, the print data is prepared so that print data in the high energy part and print data in the low energy part do not coexist.

(2-1) When print data exists in print dots q1 and Q2

If print data exists only in the objective print dot q1 and does not exist in q2 or q3 in the print control range of the low energy part shown in FIG. 1C and print data exists in Q2 and not in Q3 in the high energy part shown in FIG. 1B, q1 is set to 1," q2 to "0," q3 to "0," Q2 to "1," and Q3 to "0" in FIG. 1A.

At this time, q3 is "0," thus the NAND circuit 20 outputs "1." However, q2 is "0" in the NAND circuit 19 and Q2 set to 1 is input to the signal input circuit of q2 through the diode 30. Further, the inversion signal of the GATE C1 signal shown in FIG. 2B provided by the inverter 23 is applied to the NAND circuit 19, which then outputs "0" only for the time t6 shown in FIG. 2 and "1" otherwise.

Therefore, the AND circuit 6 outputs "1" for the time resulting (t7+t8) from subtracting the time t6 from the time T2 shown in FIG. 2 based on the STROBE2 signal and the multi-input AND circuit 4 2 also outputs "1" only for the time (t7+t8). Thus, the FET2 is also turned on only for the time for heating the heating resistor r0 of the thermal head connected to the FET 2 with the heating resistor r0 and the added resistor r1 connected in series only for the time (T2−t6).

Thus, the heating time is cut by the time t6, whereby the heat accumulation effect in the print dot Q2 in the high energy part on the objective print dot q1 can be prevented.

(2-2) When print data exists in print dots q1 and Q3

If print data exists only in the objective print dot q1 and does not exist in q2 or q3 in the print control range of the low energy part shown in FIG. 1C and print data exists in Q3 and not in Q2 in the high energy part shown in FIG. 1B, q1 is set to "1," q2 to "0," q3 to "0," Q2 to "0," and Q3 to "1" in FIG. 1A.

At this time, q2 is "0," thus the NAND circuit 19 outputs "1." However, q3 is "0" in the NAND circuit 20 and Q3 set to 1 is input to the signal input circuit of q3 through the diode 31. Further, output of the EOR circuit 21 is input to the NAND circuit 20. At this time, the inversion signal of the GATE C1 signal shown in FIG. 2B provided by the inverter 23 and the inversion signal of the GATE C2 signal shown in FIG. 2B provided by the inverter 24 are applied to the EOR circuit 21, which then outputs "1" only for the time t7 shown in FIG. 2 during which both the signals do not match in state, and "0" otherwise. Thus, the NAND circuit 20 outputs "038 only for the time t7 and "1" otherwise.

Therefore, the AND circuit 6 outputs "1" for the time (t6+t8) resulting from subtracting the time t7 from the time T2 based on the STROBE2 signal shown in FIG. 2 and the multi-input AND circuit 4 also outputs "1" only for the time (t6+t8). Thus, the FET 2 is also turned on only for the time for heating the heating resistor r0 of the thermal head connected to the FET 2 with the heating resistor r0 and the added resistor r1 connected in series only for the time (T2−t7).

Thus, the heating time is cut by the time t7, whereby the heat accumulation effect in the print dot Q3 in the high energy part on the objective print dot q1 can be prevented.

(2-3) When print data exists in print dots q1, Q2, and Q3

If print data exists only in the objective print dot q1 and does not exist in q2 or q3 in the print control range of the low energy part shown in FIG. 1C and print data exists in the print dots Q2 and Q3 in the high energy part shown in FIG. 1B, q1 is set to "1," q2 to "0," q3 to "0," Q2 to "1," and Q3 to "1" in FIG. 1A.

At this.time, q2 is "0" in the NAND circuit 19 and Q2 set to 1 is. input to the signal input circuit of q2 through the diode 30. Further, the inversion signal of the GATE C1 signal shown in FIG. 2B provided by the inverter 23 is applied to the NAND circuit 19, which then outputs "0" only for the time t6 shown in FIG. 2 and "1" otherwise.

In the NAND circuit 20, q3 is "0" and Q3 set to 1 is input to the signal input circuit of q3 through the diode 31. Further, output of the EOR circuit 21 is input to the NAND circuit 20. As described above the EOR circuit 21 outputs "1" only for the time t7 shown in FIG. 2 during which the inversion signal of the GATE C1 signal (high) and the inversion signal of the GATE C2 signal (low) do not match, and "0" otherwise. Thus, the NAND circuit 20 outputs "0" only for the time t7 in FIG. 2 and "1" otherwise.

Therefore, the AND circuit 6 outputs "1" for the time resulting from subtracting the time (t6+t7) from the time T2 based on the STROBE2 signal shown in FIG. 2, namely, t8. Thus, the FET 2 is also turned on only for the time t8=T2−(t6+t7) for heating the heating resistor r0 of the thermal head connected to the FET 2 with the heating resistor r0 and the added resistor r1 connected in series only for the time t8.

Thus, the heating time is cut by the time (t6+t7), whereby the heat accumulation effect in the print dots Q2 and Q3 in the high energy part on the objective print dot q1 can be prevented.

(2-4) When print data exists in print dots q1, q2, and Q3

If print data exists only in the objective print dot q1 and the print dot q2 and does not exist in q3 in the print control range of the low energy part shown in FIG. 1C and print data exists in Q3 and not in Q2 in the high energy part shown in FIG. 1B, q1 is set to "1," q2 to "1," q3 to "0," Q2 to "0," and Q3 to "1" in FIG. 1A.

In this case, similar control to that in (3) described above is performed, and the FET 2 is turned on only for the time t8=T2−(t6+t7).

Thus, the heating time is cut by the time (t6+t7), whereby the heat accumulation effect in the print dot Q3 in the high energy part as well as that in the print dot q2 in the low energy part on the objective print dot q1 can be prevented.

(2-5) When print data exists in print dots q1, q3, and Q2

If print data exists only in the objective print dot q1 and the print dot q3 and does not exist in q2 in the print control range of the low energy part shown in FIG. 1C and print data exists in Q2 and not in Q3 in the high energy part shown in FIG. 1B, q1 is set to "1," q2 to "0," q3 to "1," Q2 to "1," and Q3 to "1" in FIG. 1A.

Also in this case, similar control to that in (3) described above is performed, and the FET2 is turned on only for the time t8=T2−(t6+t7).

Thus, the heating time is cut by the time (t6+t7), whereby the heat accumulation effect in the print dot Q2 in the high energy part as well as that in the print dot q3 in the low energy part on the objective print dot q1 can be prevented.

One embodiment of the thermal head of the invention comprising such a control circuit will be discussed with reference to FIG. 5 and other figures. FIG. 5 shows a control example of a 64-bit print head. Parts, signals, etc., identical with those previously described with reference to other figures are denoted by the same reference numerals, symbols, etc., in FIG. 5. In FIG. 5, FET 1 and FET 2 denote FETs for controlling print of the objective print dot Q1 previously described with reference to FIG. 1A, FET L1 and FET L2 denote FETs for controlling print of a print dot on the left of the objective print dot Q1, FET R1 and FET R2 denote FETs for controlling print of a print dot on the right of the objective print dot Q1, VSS denotes a ground signal, and VDD denotes a control system power supply voltage.

Numeral 40 denotes a shift register consisting of a first 64-bit shift register to which print data for a high energy part Q is input (not shown) and a second 64-bit shift register to which print data for a low energy part q is input (not shown). In the example, according to a CLOCK signal, 64-bit input data in the high energy part Q is input in series to the first shift register from DATAin1 (Q) and 64-bit input data in the low energy part q is input in series to the second shift register from DATAin2 (q) and the 64-bit input data in the high energy part Q and the 64-bit input data in the low energy part q are output from DATAout1 (Q) and DATAout2 (q) respectively to the next stage, for example, in series. Numeral 41, 42, 43 . . . denotes a data hold register for holding 3-bit print data for the high energy part and 3-bit print data for the low energy part q.

The data hold register 41 sequentially holds only three lines of 1-bit print data transferred to an input terminal D1 according to a LOAD signal and sequentially holds only three lines of 1-bit print data transferred to an input terminal d1. The data hold register 42, 43, . . . is similar to the data hold register 41.

For example, after a first print data line for the high energy part is set in the first shift register of the shift register 40 and a first print data line for the low energy part is set in the second shift register of the shift register 40, if a LOAD signal is input to a LATCH terminal of the data hold register 41, 42, 43, . . . , the data transferred to the input terminal D1 to which the first-bit data in the first shift register is transferred is held in the data hold register 41 and is output from a terminal Q1 of the data hold register 41 and the data transferred to the input terminal d1 to which the first-bit data in the second shift register is transferred is also held in the data hold register 41 and is output from a terminal q1 of the data hold register 41.

Likewise, the second-bit data in the first shift register and that in the second shift register are output from output terminals Q1 and q1 of the data hold register 42 and the third-bit data in the first shift register and that in the second shift register are output from output terminals Q1 and q1 of the data hold register 43.

Next, after a second print data line for the high energy part is set in the first shift register of the shift register 40 and a second print data line for the low energy part is set in the second shift register of the shift register 40, if a LOAD signal is input to the LATCH terminal of the data hold register 41, 42, 43, . . . , new first-bit data in the first shift register is transferred to the input terminal D1, is held in the data hold register 41, and is output from the output terminal Q1 of the data hold register 41, and the data output so far from the output terminal Q1 is shifted to the next stage and is output from an output terminal Q2. Similar control is also performed for the second shift register. New first-bit data in the second shift register is transferred to the input terminal d1, is held in the data hold register 41, and is output from the output terminal q1 of the data hold register 41, and the data output so far from the output terminal q1 is shifted to the next stage and is output from an output terminal q2.

Likewise, the second-bit data in the first shift register and that in the second shift register are output from the output terminals Ql and q1 of the data hold register 42 and the data output so far from the output terminals Q1 and q1 is shifted to the next stage and is output from the output terminals Q2 and q2.

Similar control is also performed for the data hold register 43. The third-bit data in the first shift register and that in the second shift register are output from the output terminals Q1 and q1 of the data hold register 43 and the data output so far from the output terminals Q1 and q1 is shifted to the next stage and is output from the output terminals Q2 and q2.

After a third print data line for the high energy part is set in the first shift register of the shift register 40 and a third print data line for the low energy part is set in the second shift register of the shift register 40, if a LOAD signal is input to the LATCH terminal of the data hold register 41, 42, 43, control similar to that described above is performed. In the data hold register 41, new first-bit data in the first shift register is output from the output terminal Q1 and the data output so far from the output terminals Q1 and Q2 is shifted to the next stages and is output from output terminals Q2 and Q3. New first-bit data in the second shift register is output from the output terminal q1 and the data output so far from the output terminals q1 and q2 is shifted to the next stages and is output from output terminals q2 and q3.

Also in the data hold register 42, likewise, new second-bit data in the first shift register is output from the output terminal Q1 and the data output so far from the output terminals Q1 and Q2 is shifted to the next stages and is output from output terminals Q2 and Q3. New second-bit data in the second shift register is output from the output terminal q1 and the data output so far from the output terminals q1 and q2 is shifted to the next stages and is output from output terminals q2 and q3.

The output terminal Q2 is connected to the output terminal q2 via a diode 30 and the output terminal Q3 is connected to the output terminal q3 via a diode 31.

Also in the data hold register 43, likewise, new third-bit data in the first shift register is output from the output terminal Q1 and the data output so far from the output terminals Q1 and Q2 is shifted to the next stages and is output from output terminals Q2 and Q3. New third-bit data in the second shift register is output from the output terminal q1 and the data output so far from the output terminals q1 and q2 is shifted to the next stages and is output from output terminals q2 and q3.

The first print data line corresponds to the print line preceding the print line preceding the Q1, q1 line, the second print data line corresponds to the print line preceding the Q1, q1 line, and the third print data line corresponds to the objective print line, shown in FIGS. 1B and 1C.

The output of the output terminal Q2 of the register 41 is input to a NAND circuit 8 (corresponding to LQ2 in FIG. 1A) and the output of the output terminal Q2 of the register 43 is input to a NAND circuit 10 (corresponding to RQ2 in FIG. 1A). The control circuit similar to that previously described with reference to FIG. 1A is thus configured based on the outputs of the data hold registers 41, 42, and 43.

Therefore, control based on STROBE1 and STROBE2 signals containing heat history control responsive to the state of each print dot described above in the print control ranges shown in FIGS. 1B and 1C is performed for the FET 1. It is also performed for the FET L1, FET L2, FET R1, FET R2, . . . in a similar manner.

Figure 9A:
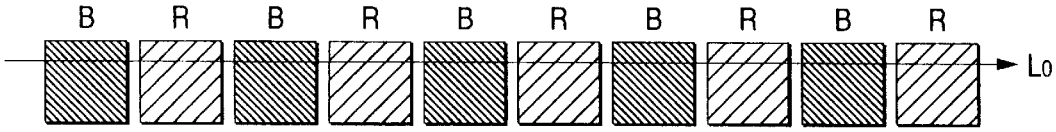
FIGS. 9A and 9B are schematic representations of multi-color printing.
Figure 9B:
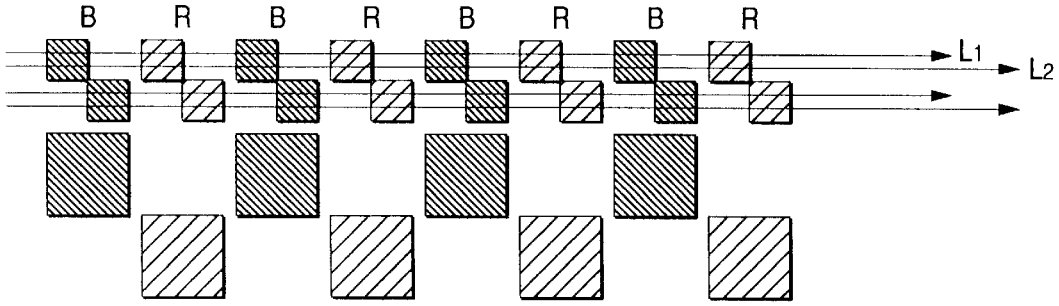
Figure 10:
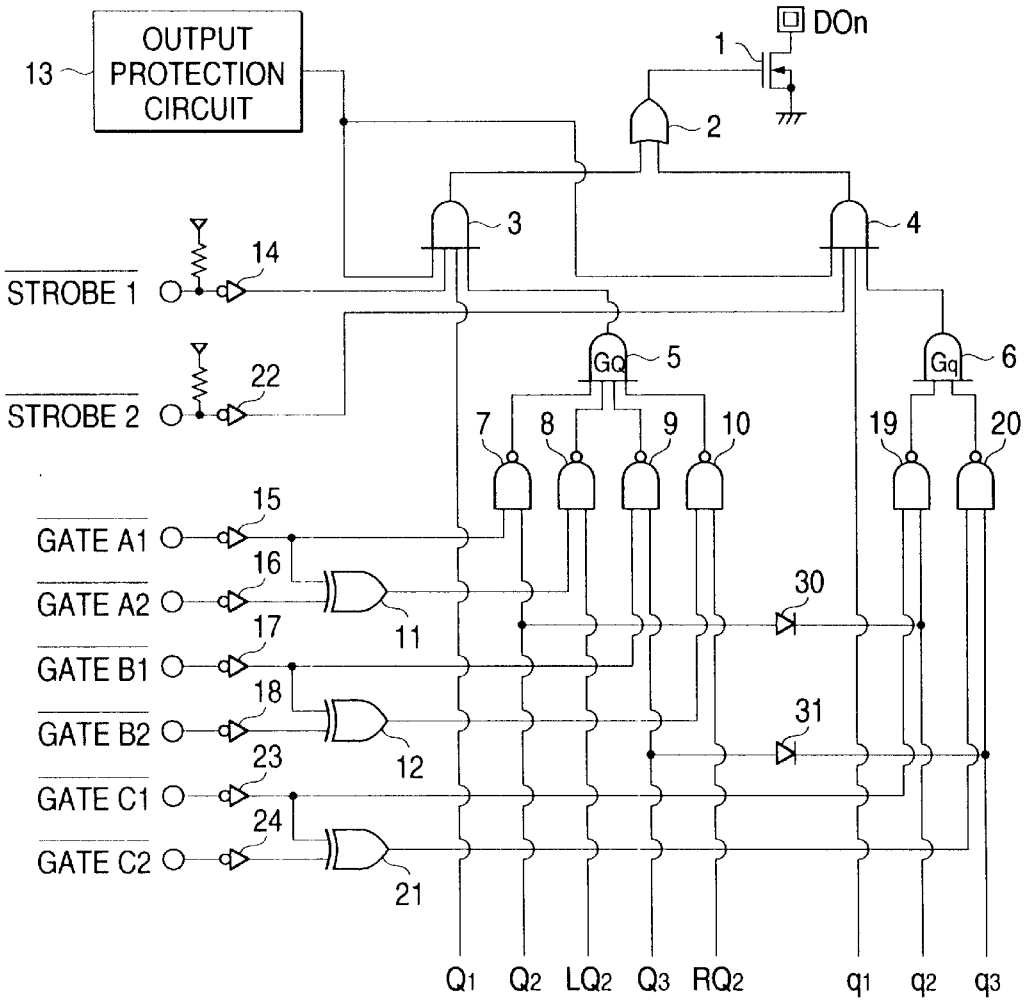
FIG. 10 shows a control circuit in a related art.
Figure 11:
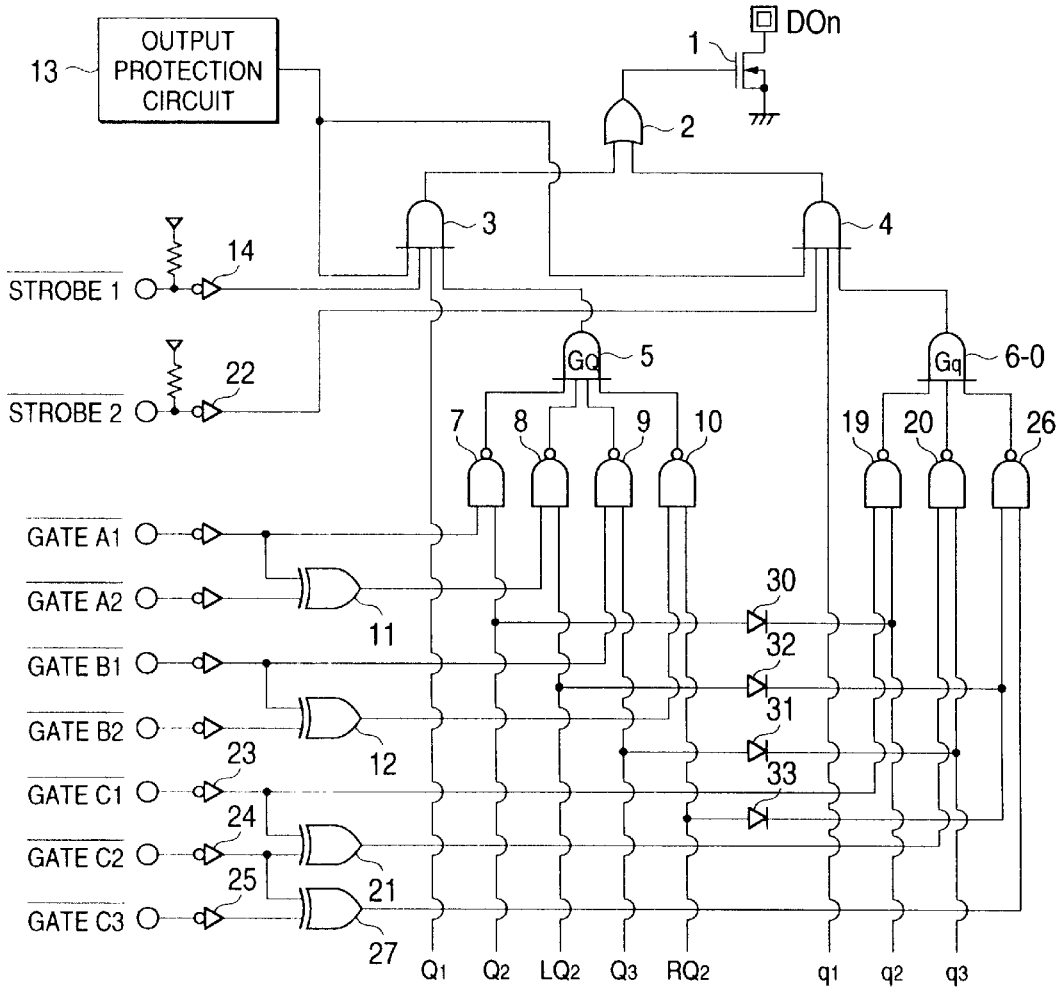
FIG. 11 shows a second control circuit in related art.
Figure 12A:
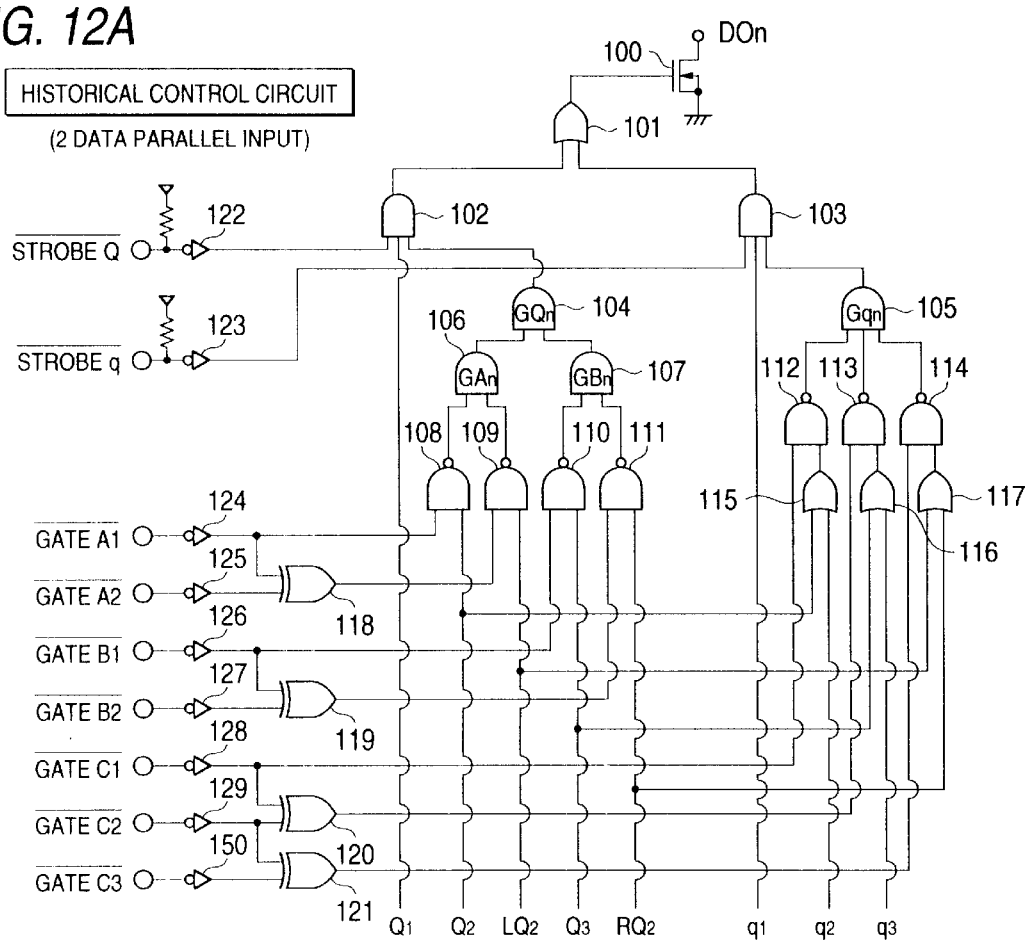
FIG. 12A is an equivalent circuit diagram and FIG. 12B is an explanatory diagram to the control circuit in FIG. 1.
Figure 12B:
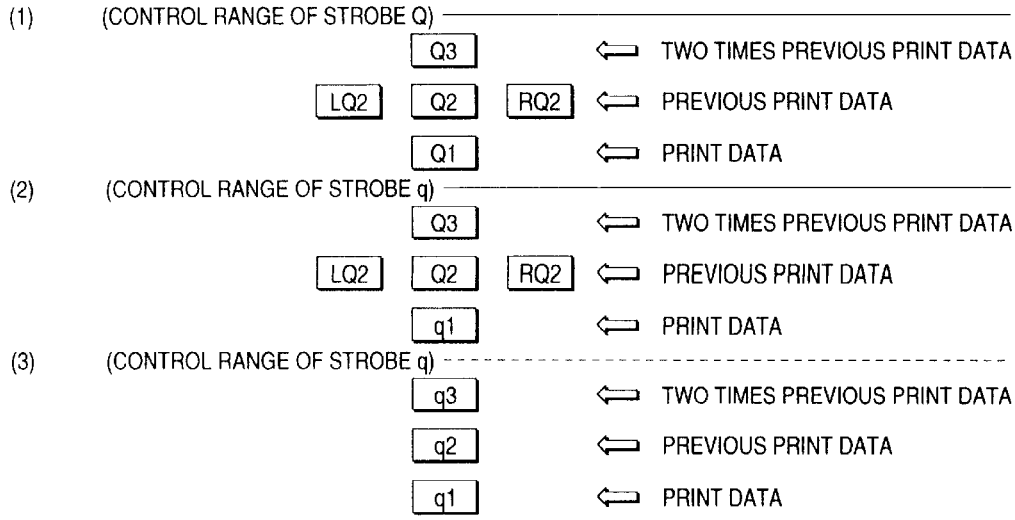

Therefore, if print data in the high energy part and that in the low energy part are input to the first and second shift registers of the shift register 40 respectively and the control signals such as the STROBE1, STROBE2, GATE A1, GATE A2, GATE B1, GATE B2, GATE C1, and GATE C2 signals previously described with reference to FIGS. 4 and 5 are input, the print control based on the print data in the high energy part and that in the low energy part containing the heat accumulation effect prevention control in the print control ranges as described above can be performed at the same time; multi-color printing is performed accurately by one scanning, for example, as shown in FIGS. 9A and 9B.

A specific configuration of thermal head in the invention will be discussed with reference to FIG.3. In the figure, numeral 100 denotes a common electrode part, numeral 101-0, 101-1, . . . denotes a heating resistor (r0), numeral 102-0, 102-1, . . . denotes a high energy side connection pad, numeral 103-0, 103-1, . . . denotes an added resistor (r1), numeral 104-0, 104-1, . . . denotes a low energy side connection pad, numeral 105-0, 105-1, . . . denotes a high energy side connection pad on the IC side, numeral 106-0, 106-1, . . . denotes a low energy side connection pad on the IC side, numeral 107-0, 107-1, . . . denotes wire for high energy side wire bonding, and numeral 108-0, 108-1, . . . denotes wire for low energy side wire bonding.

The common electrode part 100, the heating resistors 101-0, 101-1, etc., the high energy side connection pads 102-0, 102-1, . . . , the added resistors 103-0, 103-1, . . . , and the low energy side connection pads 104-0, 104-1, . . . are formed on the same insulating substrate (not shown) by a thin-film technology.

The high energy side connection pads 105-0, 105-1, . . . and the low energy side connection pads 106-0, 106-1, . . . are formed on the IC side (not shown). The high energy side connection pads 102-0, 102-1, . . . and the high energy side connection pads 105-0, 105-1, . . . are wire-bonded by the wire 107-0, the wire 107-1, . . . , and the low energy side connection pads 104-0, 104-1, . . . and the low energy side connection pads 106-0, 106-1, . . . are also wire-bonded by the wire 108-0, the wire 108-1, . . .

Since the high energy side connection pad 105-0 is connected to the FET 1 and the low energy side connection pad 106-0 is connected to the FET 2, the FETs 1 and 2 are selectively turned on as described above, whereby heating in the high energy state with the heating resistor r0 solely or heating in the low energy state with the heating resistor r0 and the added resistor r1 connected in series is controlled.

Next, a second control circuit per dot of the thermal head in the invention will be discussed with reference to FIGS. 6 and 7. FIGS. 6A to 6D show an example wherein forward print data and contiguous data in the high energy part are added to the control range. FIGS. 7A and 7B are charts to describe control signals applied to the control circuit.

Figure 6A:
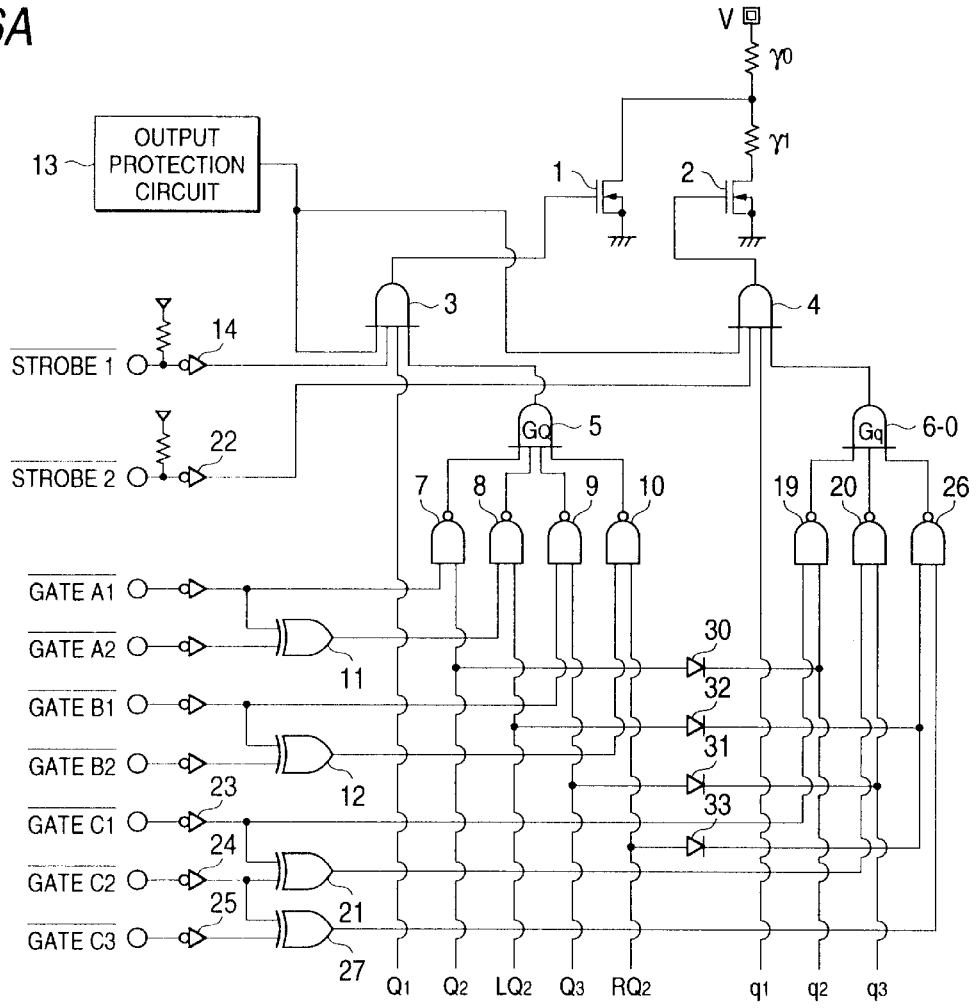
FIGS. 6A to 6D show a second control circuit per dot of thermal head in the invention.
Figure 6B:
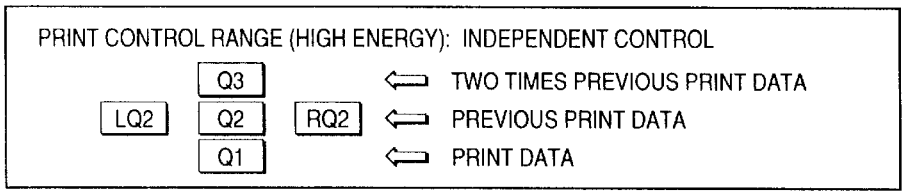

In unique control in the high energy part, the control circuit shown in FIG. 6A has the print control range of a print dot Q2 and print dots LQ2 and RQ2 on the left and right of the print dot Q2 on the print line preceding a line of an objective dot Q1 as an objective line, and a print dot Q3 on the print line preceding the LQ2, Q2, RQ2 line preceding the Q1 line, as shown in FIG. 6B.

Figure 6C:
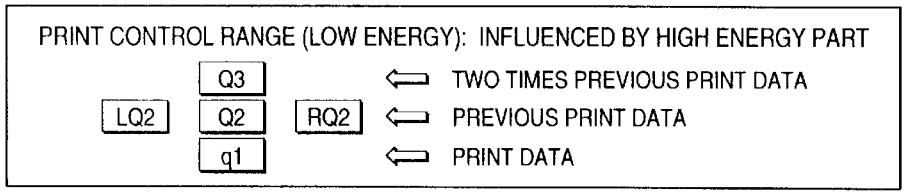
Figure 6D:
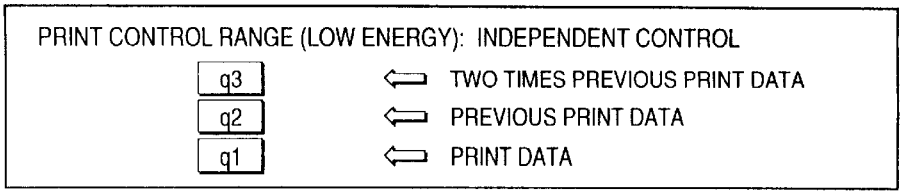

In unique control in the low energy part, the control circuit has the print control range of a print dot q2 on the print line preceding a line of an objective dot g1 as an objective line, and a print dot q3 on the print line preceding the q2 line preceding the q1 line, as shown in FIG. 6D.

In the example, the effect range of the high energy part on the objective print dot q1 in the low energy part is defined as the print dots Q2 and Q3 and the print dots LQ2 and RQ2 contiguous with the print dot Q2 on the print line preceding the Q1 line, as shown in FIG. 6C.

Thus, diodes 30, 31, 32, and 33, an inverter 25, a NAND circuit 26, an EOR circuit 27, and the like are provided as shown in FIG. 6A.

Figures 7A, 7B:
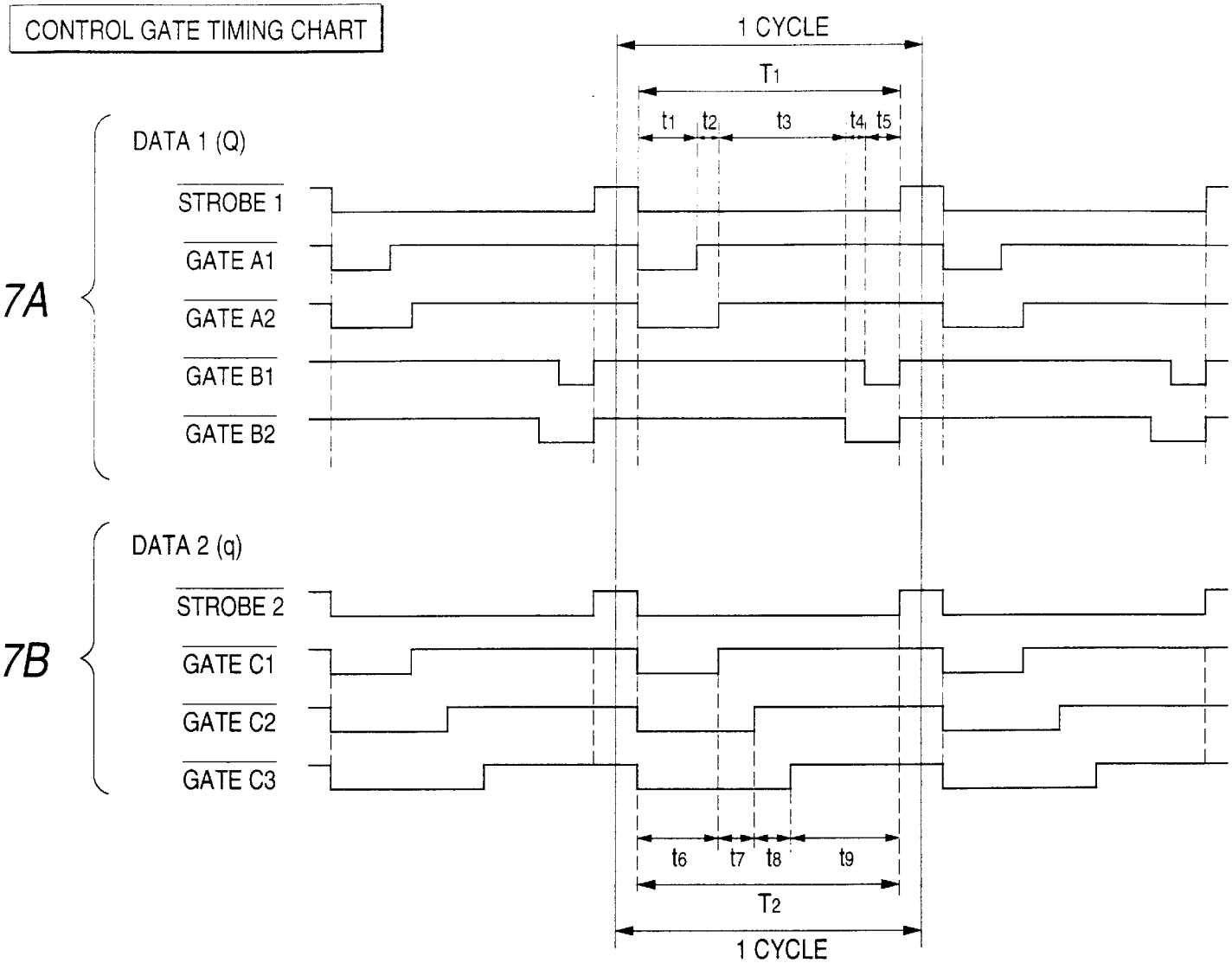
FIGS. 7A and 7B are charts to describe control signals applied to the control circuit in FIG. 6A.

A GATE C3 signal falls atthesame timeas a STROBE2 signal and rises in the time (t6+t7+t8), as shown in FIG. 7B. Of course, the time (t6+t7+t8) can be set appropriately in response to the characteristics of paper.

The diodes 30 and 31 are similar to those of the control circuit shown in FIG. 1A.

The diode 32 is provided for controlling the effect produced when print data exists in the print dot LQ2 in the high energy part; it connects a signal input circuit of the print dot LQ2 in the high energy part and one input circuit of the NAND circuit 26.

The diode 33 is provided for controlling the effect produced when print data exists in the print dot RQ2 in the high energy part; it connects a signal input circuit of the print dot RQ2 in the high energy part and one input circuit of the NAND circuit 26.

Output of the EOR circuit 27 is input to the other input circuit of the NAND circuit 26.

An inversion signal of a GATE C2 signal and an inversion signal of a GATE C3 signal are input to the EOR circuit 27.

The control circuit in FIG. 6A performs the same operation as the control circuit shown in FIG. 1A as to separate control of the high energy part. The control circuit in FIG. 6A performs the same operation as the control circuit shown in FIG. 1A as to separate control of the low energy part except that the NAND circuit 26 outputs "1" to a multi-input AND circuit 6-0 because LQ2 and RQ2 are both "0." Therefore, the operation as to separate control of the high energy part and that as to separate control of the low energy part will not be discussed again.

Representative control for the objective print data q1 in the low energy part when print data exists in LQ2, RQ2 in FIG. 6C will be discussed.

(3-1) When print data exists in print dots q1 and LQ2

If print data exists only in the objective print dot q1 and does not exist in q2 or q3 in the print control range of the low energy part shown in FIG. 6D and print data exists in LQ2 and not in Q2, Q3, or RQ2 in the high energy part shown in FIG. 6B, q1 is set to 1," q2 to "0," q3 to "0." Q2 to "0," Q3 to "0," LQ2 to "1," and RQ2 to "0" in FIG. 6A.

At this time, q2 is "0" and Q2 is "0," thus a NAND circuit 19 outputs "1," and q3 is "0" and Q3 is "0," thus a NAND circuit 20 outputs "1."

Since LQ2 is "1,""1" is applied to one input circuit of the NAND circuit 26 and output of the EOR circuit 27 is input to the other input circuit. At this time, an inversion signal of a GATE C2 signal shown in FIG. 7B provided by an inverter 24 and an inversion signal of a GATE C3 signal shown in FIG. 7B provided by the inverter 25 are applied to the EOR circuit 27, which then outputs "1" only for the time t8 shown in FIG. 7B during which both the signals do not match in state, and "0" otherwise. Thus, the NAND circuit 26 outputs "0" only for the time t8 and "1" otherwise.

Therefore, the multi-input AND circuit 6-0 outputs "1" for the time (t6+t7+t9) resulting from subtracting the time t8 from the time T2 based on the STROBE2 signal shown in FIG. 7, and a multi-input AND circuit 4 and an OR circuit 2 also output "1" only for the time (t6+t7+t9)=T2−t8. Thus, an FET2 is also turned on only for the time for heating a heating resistor r0 of the thermal head connected to the FET2 with the heating resistor r0 and an added resistor r1 connected in series only for the time (T2−t8).

Thus, the heating time is cut by the time t8, whereby the heat accumulation effect in the print dot LQ2 in the high energy part on the objective print dot q1 can be prevented.

(3-2) When print data exists in print dots q1 and RQ2

If print data exists only in the objective print dot q1 and does not exist in q2 or q3 in the print control range of the low energy part shown in FIG. 6D and print data exists in RQ2 and not in Q2, Q3, or LQ2 in the high energy part shown in FIG. 6C, q1 is set to "1," q2 to "0," q3 to "0," Q2 to "0," Q3 to "0," LQ2 to "0," and RQ2 to "1" in FIG. 6A.

At this time, q2 is "0" and Q2 is "0," thus the NAND circuit 19 outputs "1," and q3 is "0" and Q3 is "0," thus the NAND circuit 20 outputs "1."

Since RQ2 is "1," "1" is applied to one input circuit of the NAND circuit 26 and output of the EOR circuit 27 is input to the other input circuit. Therefore, as in (3-1) When print data exists in print dots q1 and LQ2, the EOR circuit 27 outputs "1" only for the time t8 shown in FIG. 7B and "0" otherwise. The heating resistor r0 of the thermal head connected to the FET2 is heated with the heating resistor r0 and the added resistor r1 connected in series only for the time (T2−t8).

Thus, the heating time is cut by the time t8, whereby the heat accumulation effect in the print dot RQ2 in the high energy part on the objective print dot q1 can be prevented.

(3-3) When print data exists in print dots q1, LQ2, and RQ2

If print data exists only in the objective print dot q1 and does not exist in q2 or q3 in the print control range of the low energy part shown in FIG. 6D and print data exists in LQ2 and RQ2 and not in Q2 or Q3 in the high energy part shown in FIG. 6C, q1 is set to "1," q2 to "0," q3 to "0," Q2 to "0," Q3 to "0," LQ2 to "1," and RQ2 to "1" in FIG. 6A.

At this time, as in (3-1) When print data exists in print dots q1 and LQ2, the EOR circuit 27 outputs "1" only for the time t8 shown in FIG. 7B and "0" otherwise. The heating resistor r0 of the thermal head connected to the FET 2 is heated with the heating resistor r0 and the added resistor r1 connected in series only for the time (T2−t8).

Thus, the heating time is cut by the time t8, whereby the heat accumulation effect in the print dots LQ2 and RQ2 in the high energy part on the objective print dot q1 can be prevented.

(3-4) When print data exists in print dots q1, Q2, and LQ2

If print data exists only in the objective print dot q1 and does not exist in q2 or q3 in the print control range of the low energy part shown in FIG. 6D and print data exists in Q2 and LQ2 and not in Q3 or RQ2 in the high energy part shown in FIG. 6C, q1 is set to "1," q2 to "0," q3 to "0," Q2 to "1," Q3 to "0," LQ2 to "1," and RQ2 to "0" in FIG. 6A.

At this time, q3 is "0" and Q3 is "0," thus the NAND circuit 20 outputs "1." However, q2 is "0" in the NAND circuit 19 and Q2 set to 1 is input to the signal input circuit of q2 through the diode 30. Further, an inversion signal of a GATE C1 signal shown in FIG. 7B provided by an inverter 23 is applied to the NAND circuit 19, which then outputs "0" only for the time t6 shown in FIG. 7B and "1" otherwise.

Since LQ2 is "1,""1" is applied to one input circuit of the NAND circuit 26 via the diode 32 and output of the EOR circuit 27 is input to the other input circuit. At this time, an inversion signal of a GATE C2 signal shown in FIG. 7B provided by an inverter 24 and an inversion signal of a GATE C3 signal shown in FIG. 7B provided by the inverter 25 are applied to the EOR circuit 27, which then outputs "1" only for the time t8 shown in FIG. 7B during which both the signals do not match in state, and otherwise. Thus, the NAND circuit 26 outputs "0" only for the time t8 and "1" otherwise.

Therefore, the multi-input AND circuit 6-0 outputs "1" for the time (t7+t9) resulting from subtracting the times t6 and t8 from the time T2 based on the STROBE2 signal shown in FIG. 7B, and the multi-input AND circuit 4 and the OR circuit 2 also output "1" only for the time (t7+t9)=T2−(t6+t8). Thus, the FET 2 is also turned on only for the time for heating the heating resistor r0 of the thermal head connected to the FET 2 with the heating resistor r0 and the added resistor r1 connected in series only for the time [T2−(t6+t8)].

Thus, the heating time is cut by the time (t6+t8), whereby the heat accumulation effect in the print dots Q2 and LQ2 in the high energy part on the objective print dot q1 can be prevented.

(3-5) When print data exists in print dots q1, Q3, and LQ2

If print data exists only in the objective print dot q1 and does not exist in q2 or q3 in the print control range of the low energy part shown in FIG. 6D and print data exists in Q3 and LQ2 and not in Q2 or RQ2 in the high energy part shown in FIG. 6C, q1 is set to "1," q2 to "0," q3 to "0," Q2 to "0," Q3 to "1," LQ2 to "1," and RQ2 to "0" in FIG. 6A.

At this time, q2 is "0" and Q2 is "0," thus the NAND circuit 19 outputs "1." However, q3 is "0" in the NAND circuit 20 and Q3 set to 1 is input to the signal input circuit of q3 through the diode 31. Further, output of the EOR circuit 21 is input to the other input circuit of the NAND circuit 20. At this time, the inversion signal of the GATE C1 signal shown in FIG. 7B provided by the inverter 23 and the inversion signal of the GATE C2 signal shown in FIG. 7B provided by the inverter 24 are applied to the EOR circuit 21, which then outputs "1" only for the time t7 shown in FIG. 7B during which both the signals do not match in state, and "0" otherwise. Thus, the NAND circuit 20 outputs "0" only for the time t7 and "1" otherwise.

Since LQ2 is "1," the NAND circuit 26 outputs "0" only for the time t8 and "1," otherwise as in (3-1) When print data exists in print dots q1 and LQ2.

Therefore, the multi-input AND circuit 6-0 outputs "1" for the time (t6+t9) resulting from subtracting the times t7 and t8 from the time T2 based on the STROBE2 signal shown in FIG. 7B, and the multi-input AND circuit 4 and the OR circuit 2 also output "1" only for the time (t6+t9)=T2−(t7+t8). Thus, the FET 2 is also turned on only for the time for heating the heating resistor r0 of the thermal head connected to the FET 2 with the heating resistor r0 and the added resistor r1 connected in series only for the time [T2−(t7+t8)].

Thus, the heating time is cut by the time (t7+t8), whereby the heat accumulation effect in the print dots Q3 and LQ2 in the high energy part on the objective print dot q1 can be prevented.

In addition to the cases described above, the adverse effect of print dots in the high energy part can also be prevented by the control circuit in FIG. 6A.

Thus, in the invention, high energy print control and low energy print control can be performed very accurately, so that accurate printing can be executed if two-color data is mixed.

The embodiment for two types of energies, namely, high energy and low energy has been described, but the invention is not limited to the specific embodiment, needless to say.

The colors are not limited to red and black; green and black or any other color combination or a combination of three or more colors is also possible.

Another embodiment of the invention will be discussed.

A rewritable print medium, such as an "Aladdin card" (registered trademark) manufactured by Tokyo Magnetic Printing Co. Ltd.(JP), is available. When high energy is given to the rewritable print medium by a thermal head, the medium is printable, but when low energy is given, change is made to a different color and characters, etc., printed on the medium by high energy are erased and characters, graphics, etc., can be again written on the medium by giving high energy.

The control circuits shown in FIGS. 1 and 6 can also be used for such a medium. In this case, a STROBE1 signal is set so as to add high energy for printing and a STROBE2 signal is set so as to give low energy for erasing print characters, etc. In this case, q1, q2, and q3 become print erasure data for performing print erasure control. For the medium, it is very strict to set the range of low energy for erasing characters, etc. Thus, preferably the heat history control based on the presence or absence of q2, q3 described above, namely, heating control based on the print erasure data q2, q3 is added, the unit power value is suppressed with an added resistor, and the magnitude of the STROBE2 signal is adjusted for making energy adjustments.

Thus, the thermal head for the rewritable medium can also be provided.

In the description, STROBE2 has an equal duration to that of STROBE1, but the invention is not limited thereto, of course; STROBE2 may be larger than or small than STROBE1.

Figure 14:
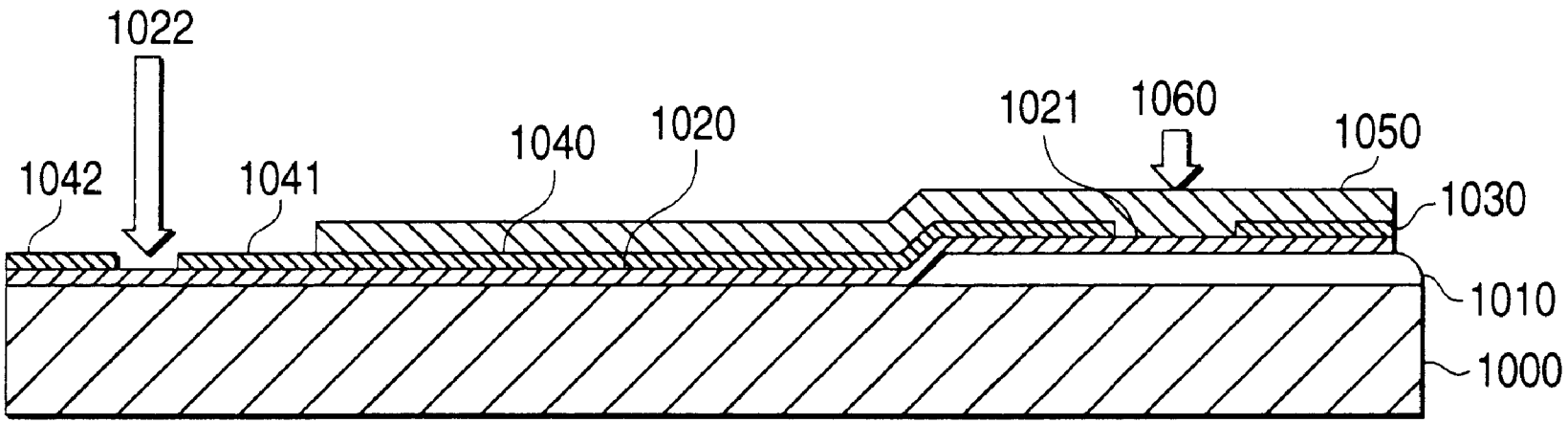
FIG. 14 is a sectional view of a heating portion of a dual power thermal head to show one embodiment of the invention.
Figure 15:
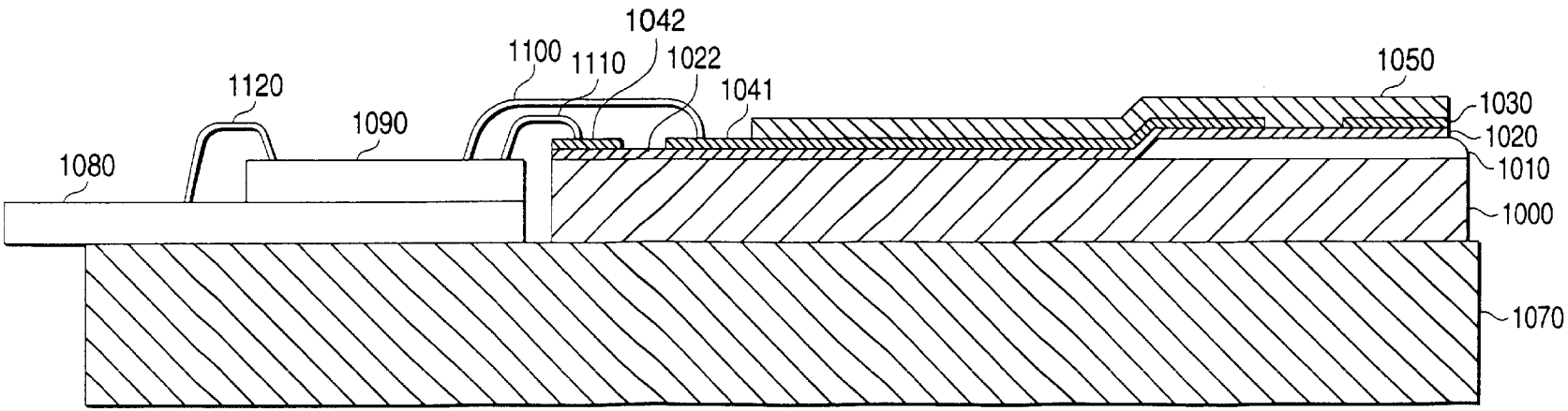
FIG. 15 is a schematic representation of a connection state of the heating portion of the dual power thermal head of the invention.

A construction of the thermal head of the present invention will be explained with reference to FIGS. 14 and 15. FIG. 14 is a sectional view of a heating portion of a dual power thermal head to show one embodiment of the invention. FIG. 15 is a schematic representation of a connection state of the heating portion of the dual power thermal head of the invention.

As shown in FIG. 14, a thermal head of the invention comprises a glaze layer 1010 formed on an insulating substrate 1000 like alumina. The glaze layer 1010 is formed partially at a position of a heating part 1060 (described later) of the insulating substrate 1000.

A boron-doped polysilicon layer 1020 is formed on the insulating substrate 1000 and the glaze layer 1010. The polysilicon layer 1020 is formed in one end part with a common electrode layer 1030 of aluminum, for example. A conductive line 1040 of aluminum, for example, is provided separating a heating resistance part 1021. The conductive line 1040 is provided in print dot units of the thermal head.

The left end of the conductive line 1040 becomes a first electrode connection part 1041 (described. later). A second electrode connection part 1042 (described later) made of the conductive line 1040 is provided separating a polysilicon layer functioning as an added resistance part 1022 from the first electrode connection part 1041.

As shown in FIG. 14, a protective layer 1050 made of SiBP, for example, is formed on the polysilicon layer 1020, the common electrode layer 1030, and the conductive line 1040. The heating resistance part 1021 and the protective layer portion thereabove make up the heating part 1060 for heating heat-sensitive paper.

The insulating substrate 1000 formed with the glaze layer 1010, the polysilicon layer 1020, the common electrode layer 1030, the conductive line 1040, the protective layer 1050, etc., is placed on a support aluminum plate 1070 as shown in FIG. 15. In addition, an interface substrate 1080 is also placed on the support aluminum plate 1070, and a drive IC 1090 is attached onto the interface substrate 1080. The drive IC 1090 comprises a control circuit containing FET1 and FET2 of switching means as above-described with reference to FIG. 1.

The first electrode connection part 1041 and the second electrode connection part 1042 are connected to the drive IC 1090 by first electrode connection wire 1100 and second electrode connection wire 1110, and the drive IC 1090 is connected via the interface substrate 1080 to an external circuit, such as a shift register later described with reference to FIG. 5, by external connection wire 1120.

In the high energy state, first switching means connected to the first electrode connection part 1041 is turned on for heating the heating element layer 1021. In the low energy state, second switching means connected to the second electrode connection part 1042 is turned on for heating the heating element layer 1021 with the heating element layer 1021 and the added resistance part 1022 connected in series. At this time, heat produced in the added resistance part 1022 is radiated via the insulating substrate.

In FIG. 14, letting the resistance value of the heating resistance part 1021 of the polysilicon layer 1020 between the common electrode layer 1030 and the conductive line 1040 be r0 and the resistance value of the added resistance part 1022 of the polysilicon layer 1020 between the first electrode connection part 1041 and the second electrode connection part 1042 be r1, heating power W0 intheheating resistance part 1021 when terminal voltage V is applied between the first electrode connection part 1041 and the common electrode layer 1030 becomes as in the following expression (1) from a circuit in FIG. 4C:

$$w0=V^2/r0 \quad (1)$$

Heating power W1 in the heating resistance part 1021 and heating power W2 in the added resistance part 1022 when terminal voltage V is applied between the second electrode connection part 1042 and the common electrode layer 103 becomes as in the following expressions (2) and (3) from a circuit in FIG. 3C:

$$W1=(V\cdot r0/(r0+r1))^2/r0 \quad (2)$$

$$W2=(V\cdot r1/(r0+rl))^2/r1 \quad (3)$$

As has been mentioned, in the thermal head proposed in (Japanese Patent Application No. Hei 10-12320, as shown in FIG. 3A, the power W0 applied in the unit time from the heating resistor to heat-sensitive paper is the same regardless of the high or low energy state; in the high energy state, the heating time t2 is set longer than the heating time t1 in the low energy state, whereby the applied energy to heat-sensitive paper in the high energy state becomes W0×t2 and is made larger by the heating time difference t2−t1 than the applied energy W0·t1 in the low energy state.

In contrast, in the invention, as shown in FIG. 4B, the power applied in the unit time from the heating resistor to heat-sensitive paper is W0 in the high energy state, but becomes w1 in the low energy state, which is lower than W0. Therefore, if the heating time is set to t2 in both the states as shown in FIG. 4B, the applied energy to heat-sensitive paper in the high energy state becomes W0·t2 and becomes larger than the applied energy in the low energy state, W1·t2. The unit heating value in the heating resistance is thus adjusted, whereby the low energy state can be entered. In the description with reference to FIG. 4B, the heating time in the high energy state is the same as that in the low energy state, but they need not be the same; the different heating times can be set appropriately depending on the nature of paper.

Moreover, in the invention, to operate the thermal head in the low energy state, the heat shown in expression (3) is generated in the added resistance part 1022; the added resistance part 1022 is placed in a portion where the glaze layer does not exist, whereby heat radiation can be enhanced and the effect of heat as the thermal head can be lessened as much as possible.

According to the invention, the following advantages can be provided:

The following selection can be controlled: The added resistor is connected to the heating element and only the heating element is placed in the operational state with high energy by the first switching means 1 and the second switching means 2 or the heating element and the added resistor are connected in series and placed in the operational state with low energy. Thus, a dual power type thermal head that can be not only controlled in the high energy state and the low energy state, but also operated for a long time in the low energy state can be provided.

Since the heating element and the added resistor are made of the same thin-film resistance, a small-sized dual power type thermal head with a high resolution can be provided.

Since the thin-film resistor comprising the heating resistance part and the added resistance part formed integrally is formed on the insulation substance and the glaze layer is formed below the heating resistance part, heat produced in the heating resistance part is accumulated in the glaze layer and heat-sensitive paper can be heated accurately. In addition, heat produced in the added resistance part can be well radiated via the insulating substrate on which the glaze layer is not formed. Thus, although the heating resistance part and the added resistance part are formed integrally, occurrence of the adverse effect caused by heating the added resistance part can be suppressed.

Since the heating resistance part and the added resistance part are energized with the heating resistance part and the added resistance part connected in series based on input of a second strobe signal, the unit heating value of the heating resistance part can be made smaller than that in the high energy state in which only the heating resistance part is energized solely. Thus, a dual power type thermal head suitable for heat-sensitive paperwhosecharacteristicinthelowenergystaterequiresasmall unit heating value can be provided.

What is claimed is:

1. A multi power type thermal head comprising:

a heating element for producing heat with different energies;

an added resistor being connected to said heating element;

first switch means for controlling said heating element in an operation state or a nonoperational state;

second switch means for controlling said heating element and said added resistor in an operation state or a nonoperational state;

first strobe signal input means for causing said first switching means to perform heating control of said heating element corresponding to first energy;

second strobe signal input means for causing said second switching means to perform heating control of said heating element corresponding to second energy;

first heating time control means for performing print control with the first energy and controlling heating time of said heating element based on a first strobe signal in response to the presence or absence of print data in a print control range of objective print data; and second heating time control means for performing print control with the second energy and controlling heating time of said heating element based on a second strobe signal in response to the presence or absence of print data in a print control range of objective print data.

2. The multi power type thermal head as claimed in claim 1 wherein said heating element and said added resistor are made of thin-film resistance formed on the same insulating substrate.

3. A thermal head as claimed in claim 1, further comprising connection means for notifying said second heating time control means with print data being printed by the first energy, which influence the heating control by said second heating time control means, wherein said second heating time control means controls the heating time period according to a signal transmitted from said connection means.

4. A thermal head as claimed in claim 2, further comprising connection means for notifying said second heating time control means with print data being printed by the first energy, which influence the heating control by said second heating time control means, wherein said second heating time control means controls the heating time period according to a signal transmitted from said connection means.

5. A multi power type thermal head comprising:

a thin-film resistance layer comprising a heating resistance part formed on a glaze layer provided partially on an insulating substrate and an added resistance part formed on the insulating substrate, the heating resistance part and the added resistance part being formed integrally;

a first electrode connection part being placed on said thin-film resistance layer and connected to first switching means; and a second electrode connection part being placed on said thin-film resistance layer and connected to second switching means.

6. A multi power type thermal head comprising:

a thin-film resistance layer comprising a heating resistance part formed on a glaze layer provided partially on an insulating substrate and an added resistance part formed on the insulating substrate, the heating resistance part and the added resistance part being formed integrally;

a first electrode connection part being placed on said thin-film resistance layer and connected to first switching means;

a second electrode connection part being placed on said thin-film resistance layer and connected to second switching means;

first strobe signal input means for causing the first switching means to perform heating control of the heating resistance part with first energy; and second strobe signal input means for causing the second switching means to perform heating control of the heating resistance part with second energy, characterized in that the heating resistance part and the added resistance part are connected in series and energized based on input of a second strobe signal and the unit heating value of the heating resistance part is smaller than that of heat produced in the heating resistance part based on input of a first strobe signal.

7. A driving control apparatus for a thermal head comprising:

a heating element for producing heat with different energies;

an added resistor being connected to said heating element;

first switch means for controlling said heating element in an operation state or a nonoperational state;

second switch means for controlling said heating element and said added resistor in an operation state or a nonoperational state;

first strobe signal input means for causing said first switching means to perform heating control of said heating element corresponding to first energy;

second strobe signal input means for causing said second switching means to perform heating control of said heating element corresponding to second energy;

first heating time control means for performing print control with the first energy and controlling heating time of said heating element based on a first strobe signal in response to the presence or absence of print data in a print control range of objective print data; and second heating time control means for performing print control with the second energy and controlling heating time of said heating element based on a second strobe signal in response to the presence or absence of print data in a print control range of objective print data.

8. A thermal head comprising:

a heating element for producing heat with different energies;

an added resistor being connected to said heating element;

first switch means for controlling said heating element in an operation state or a nonoperational state;

second switch means for controlling said heating element and said added resistor in an operation state or a nonoperational state;

first strobe signal input means for causing said first switching means to perform heating control of said heating element corresponding to first energy;

second strobe signal input means for causing said second switching means to perform heating control of said heating element corresponding to second energy;

first heating time control means for performing print control with the first energy and controlling heating time of said heating element based on a first strobe signal in response to the presence or absence of print data in a print control range of objective print data; and second heating time control means for performing print control with the second energy and controlling heating time of said heating element based on a second strobe signal in response to the presence or absence of print data in a print control range of objective print data.

* * * * *